US007147029B2

(12) United States Patent
Kovach et al.

(10) Patent No.: US 7,147,029 B2
(45) Date of Patent: Dec. 12, 2006

(54) REMOTE CONTROL OPERATING SYSTEM AND SUPPORT STRUCTURE FOR A RETRACTABLE COVERING FOR AN ARCHITECTURAL OPENING

(75) Inventors: Joseph E. Kovach, Brighton, CO (US); Michael S. Holford, Thornton, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 10/732,747

(22) Filed: Dec. 10, 2003

(65) Prior Publication Data

US 2004/0118528 A1 Jun. 24, 2004

Related U.S. Application Data

(62) Division of application No. 09/940,768, filed on Aug. 27, 2001, now Pat. No. 6,688,368, which is a division of application No. 09/339,089, filed on Jun. 22, 1999, now Pat. No. 6,299,115.

(60) Provisional application No. 60/090,269, filed on Jun. 22, 1998.

(51) Int. Cl.
*E06B 9/08* (2006.01)

(52) U.S. Cl. ..... 160/121.1; 160/84.05; 160/84.02

(58) Field of Classification Search ..... 160/168.1 P, 160/176.1 P, 188, 310
See application file for complete search history.

(56) References Cited

U.S. PATENT DOCUMENTS

| | | | | |
|---|---|---|---|---|
| 2,649,269 A | | 8/1953 | Hart | 248/262 |
| 2,698,727 A | | 1/1955 | Rutledge | 248/264 |
| 3,889,439 A | | 6/1975 | Kasper | 52/709 |
| 4,411,401 A | | 10/1983 | Anderson | 248/262 |
| 4,436,269 A | | 3/1984 | Dirksing et al. | 284/214 |
| 4,657,060 A | | 4/1987 | Kaucic | 160/168.1 V |
| 4,878,528 A | | 11/1989 | Kobayashi | 160/168.1 |
| 5,131,616 A | | 7/1992 | Biba | 248/265 |
| 5,195,570 A | | 3/1993 | Marocco | 160/178.1 |
| 5,402,047 A | * | 3/1995 | Bresson et al. | 318/287 |
| 5,664,613 A | | 9/1997 | Jelic | 160/84.05 |
| 5,847,525 A | * | 12/1998 | Cheron et al. | 318/468 |
| 6,060,852 A | * | 5/2000 | Domel et al. | 318/480 |
| 6,062,290 A | * | 5/2000 | Domel | 160/176.1 V |
| 6,148,893 A | | 11/2000 | Cadorette | 160/176.1 P |

* cited by examiner

*Primary Examiner*—Blair M. Johnson
(74) *Attorney, Agent, or Firm*—Dorsey & Whitney LLP

(57) ABSTRACT

An improved retractable covering for an architectural opening includes an improved mounting bracket, an improved limit stop to prevent over-retraction and over-extension of the retractable covering, an improved battery pack mounting bracket for attaching a power supply to a head rail of the retractable covering, an improved battery pack mounting apparatus for attaching a battery pack to a head rail, an improved control system for the retractable covering, and an improved method of using a wireless remote control or a manually operated switch to activate a motor to control the configuration of the covering, including the extension or retraction of the covering, and the transmissivity of the covering. The disclosed improvements are field retrofittable.

19 Claims, 25 Drawing Sheets

REMOTE CONTROL OPERATING SYSTEM AND SUPPORT STRUCTURE FOR A RETRACTABLE COVERING FOR AN ARCHITECTURAL OPENING

CROSS-REFERENCES TO RELATED APPLICATION

The present application is a division of U.S. application Ser. No. 09/940,768, filed Aug. 27, 2001, now U.S. Pat. No. 6,688,368, which is a division of U.S. application Ser. No. 09/339,089, filed Jun. 22, 1999, now U.S. Pat. No. 6,299,115, issued on Oct. 9, 2001, which claims priority to U.S. provisional application No. 60/090,269, filed Jun. 22, 1998. Each of the above-referenced applications are hereby incorporated by reference as though fully set forth herein.

BACKGROUND OF THE INVENTION a. Field of the Invention

The instant invention is directed toward a support structure and remotely controllable operating system for a retractable covering for an architectural opening. More specifically, it relates to the hardware for supporting a retractable covering for an architectural opening, and includes a control system that may be controlled manually or by use of a remote control transmitter.

b. Background Art

It is well known that it is frequently desirable to place retractable coverings for architectural openings in remote locations that are not easily accessible (e.g., coverings over windows that are substantially above ground level). In order to take advantage of the benefits inherent in such retractable coverings, it is necessary to be able to operate the coverings from a distance, and possibly without physically touching the actual hardware that retracts and extends the covering.

Although various attempts have been made to address the problems presented by such a remotely mounted covering, there remains a need for an improved apparatus for permitting remote operations of such remotely mounted retractable coverings for an architectural openings.

Prior attempts to control the retraction and extension of a covering using an electric motor have employed mechanical limit switches to stop the extension or retraction of the covering. It is, however, desirable to eliminate the presence of such mechanical limit switches.

SUMMARY OF THE INVENTION

It is an object of the disclosed invention to provide an improved retractable covering for an architectural opening.

It is a further object of the disclosed invention to improve the retractable covering with an improved mounting bracket. In one form of the mounting bracket, it has a top surface with at least one mounting slot through it, a back surface with at least one mounting slot through it, an upper leg, a lower leg, a lip slot defined between the upper leg and the lower leg, a pressure strip including a distal end and an opposite end, and a retention clip including a downward projecting portion. The retention clip is attached to the distal end of the pressure strip, and the opposite end of the pressure strip is mounted to the upper leg. In another form of the mounting bracket, the lower leg includes a split tongue having a compression slot across its width. In yet another form, the mounting bracket top surface has two adjustable mounting slots through it, and the back surface also has two adjustable mounting slots through it.

It is a further object of the disclosed invention to improve the retractable covering with an improved limit stop to prevent over-retraction and over-extension of the retractable covering. In one form of the limit stop, it has a mounting half and a working half that are pivotally attached to each other. The working half further includes a main body with an outer edge having at least one bottom rail stop arm projecting therefrom. The main body of the working half also includes an underside having at least one curvilinear portion extending therefrom and forming a pocket at it intersection with the main body of the working half. In a preferred form, the working half is pivotally attached to the mounting half by a hinge pin. If a hinge pin is used, the working half includes a main body having a hinge edge with a plurality of alternating hinge portions projecting therefrom, and the mounting half also includes a main body having a hinge edge with a plurality of alternating hinge portions projecting therefrom. The hinge portions from the working half cooperate with the hinge portions from the mounting half. It is yet a further object of the disclosed invention to improve the retractable covering with an improved battery pack mounting bracket for attaching a power supply to a head rail of the retractable covering. In one form of the battery pack mounting bracket, it includes a tongue having a base, and at least one upper leg attached to the base of the tongue so as to define a lip slot. This battery pack mounting bracket may be part of a battery pack mounting apparatus for attaching a battery pack to a head rail. The apparatus includes at least two battery pack mounting brackets and a distancing strip. The distancing strip establishes an appropriate distance between the two battery pack mounting brackets. In a preferred form, the distancing strip includes downward projecting lips that clip over the battery pack mounting brackets. Alternatively, the distancing strip may include one or more holes that server to position the distancing strip relative to the two battery pack mounting brackets. In another form, the battery pack mounting apparatus includes a first battery pack holding means to removably secure the battery pack to one of the battery pack mounting brackets, and a second battery pack holding means to removably secure the battery pack to the other of the battery pack mounting brackets.

It is a further object of the disclosed invention to improve the retractable covering with an improved control system that, if desired, may be operated at a location remote from the actual hardware attached to the retractable covering. In one form of the control system, it includes a means for mounting the retractable covering adjacent to an architectural opening, a power source, means for rotating an element on which the covering is rolled, means for commanding the means for rotating the element, means for preventing over-extension of the covering, and means for preventing over-retraction of the covering.

It is still a further object of the disclosed invention to improve the retractable covering with an improved method of using a wireless remote control or a manually operated switch to activate a motor to control the configuration of the covering, including the extension or retraction of the covering, and the transmissivity of the covering. If a wireless remote control, having an up button and a down button, is used, the method includes monitoring an amount of extension of the covering, monitoring an amount of transmissivity of the covering, monitoring a speed of the covering, and monitoring a signal from the remote control for an indication of a pressing of either the up button or the down button. Then, the method includes commanding the motor to make a predetermined adjustment to the covering upon recognizing a single press and release of either the up button or the down button, wherein the predetermined adjustment is based upon the monitored amount of extension, the monitored amount of transmissivity, the monitored speed, and the monitored signal. If a manual operating switch is used, the method includes monitoring an amount of extension of the covering, monitoring an amount of transmissivity of the covering, monitoring a speed of the covering, and monitoring a signal from the manual operating switch for an indication of a pressing of the manual operating switch. Then, the method includes commanding the motor to make a predetermined adjustment to the covering upon recognizing a single press and release of the manual operating switch, wherein the predetermined adjustment is based upon the monitored amount of extension, the monitored amount of transmissivity, the monitored speed, and the alternating treatment of the press of the manual operating switch as either an up request or a down request.

It is a further object of the disclosed invention that the remote control aspects of the control system be field retrofittable.

A more detailed explanation of the invention is provided in the following description and claims, and is illustrated in the accompanying drawings.

DESCRIPTION OF THE PREFERRED EMBODIMENTS

Figure 1:
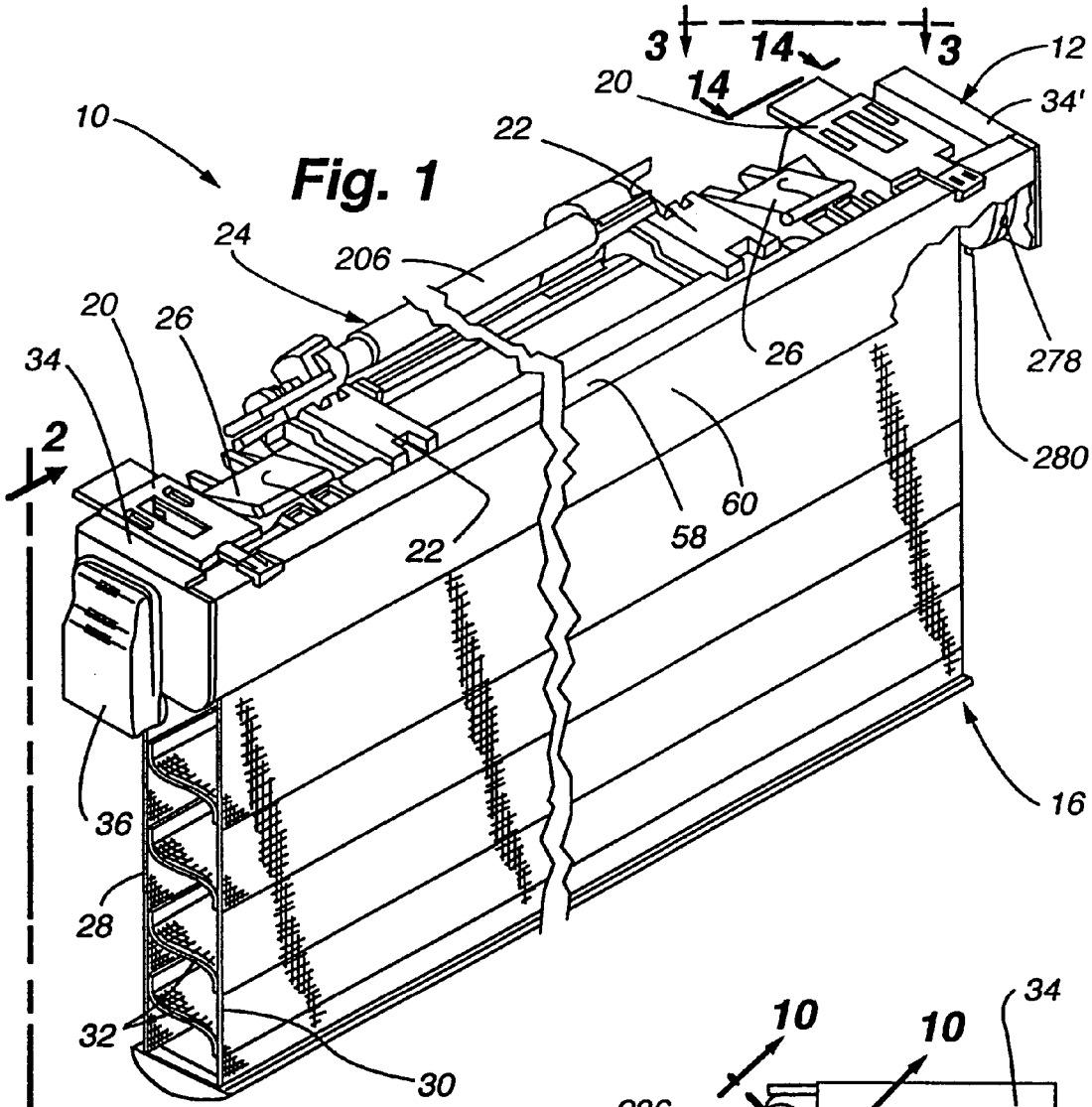
FIG. 1 is a fragmentary isometric view of the top and front of a retractable covering according to the present invention.
Figure 2:
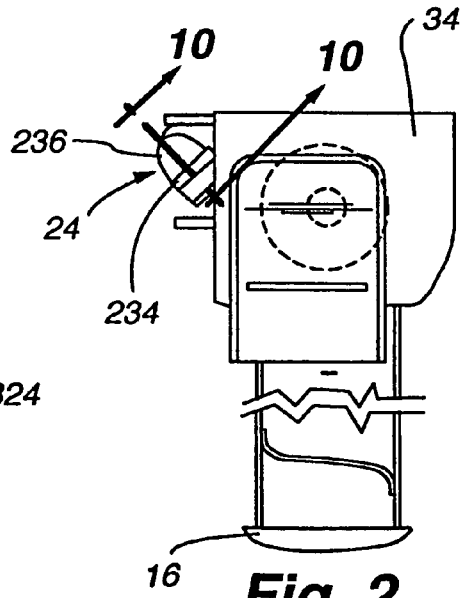
FIG. 2 is a fragmentary end view taken along line 2—2 of the apparatus depicted in FIG. 1.
Figure 1A:
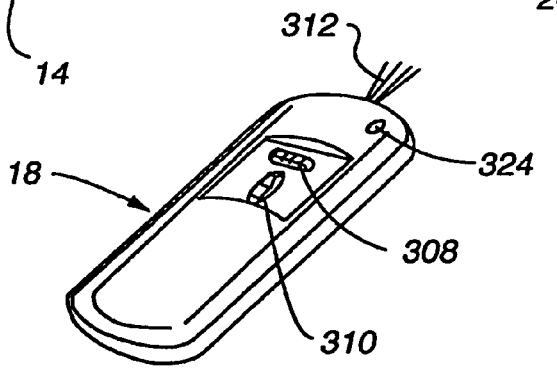
FIG. 1A is an isometric view of a remote control comprising part of the present invention.

In general, the instant invention relates to a remotely-controllable retractable covering for architectural openings 10. As depicted in FIGS. 1 and 1A, the apparatus comprises a control system mounted in a head rail 12 for extending, retracting, and otherwise adjusting a covering 14 attached between the head rail 12 and a bottom rail 16, wherein the control system mounted in the head rail may be operated using a remote control 18. In a preferred embodiment, two main mounting brackets 20 attach the head rail 12 to a desired mounting surface (e.g., a wall above the opening), two battery pack mounting brackets 22 attach a power supply 24 to the head rail 12, and two limit stops 26 prevent over-retraction and over-extension of the covering 14. A particularly preferred covering 14 for use with the present invention comprises a first flexible sheet 28 and a second flexible sheet 30 with vanes 32 attached between these first and second flexible sheets 28, 30, respectively. The first and second flexible sheets 28, 30, respectively, are secured to the bottom rail 16. Left and right end caps 34, 34', respectively, support components, aesthetically shield various internal components from view, and include auxiliary support pockets 36 that may be used in select applications to position the head rail 12 above an architectural opening to be covered. As depicted in FIG. 2, the power supply 24 is hidden from view in the preferred embodiment when the head rail 12 is attached to a mounting surface.

Figure 3:
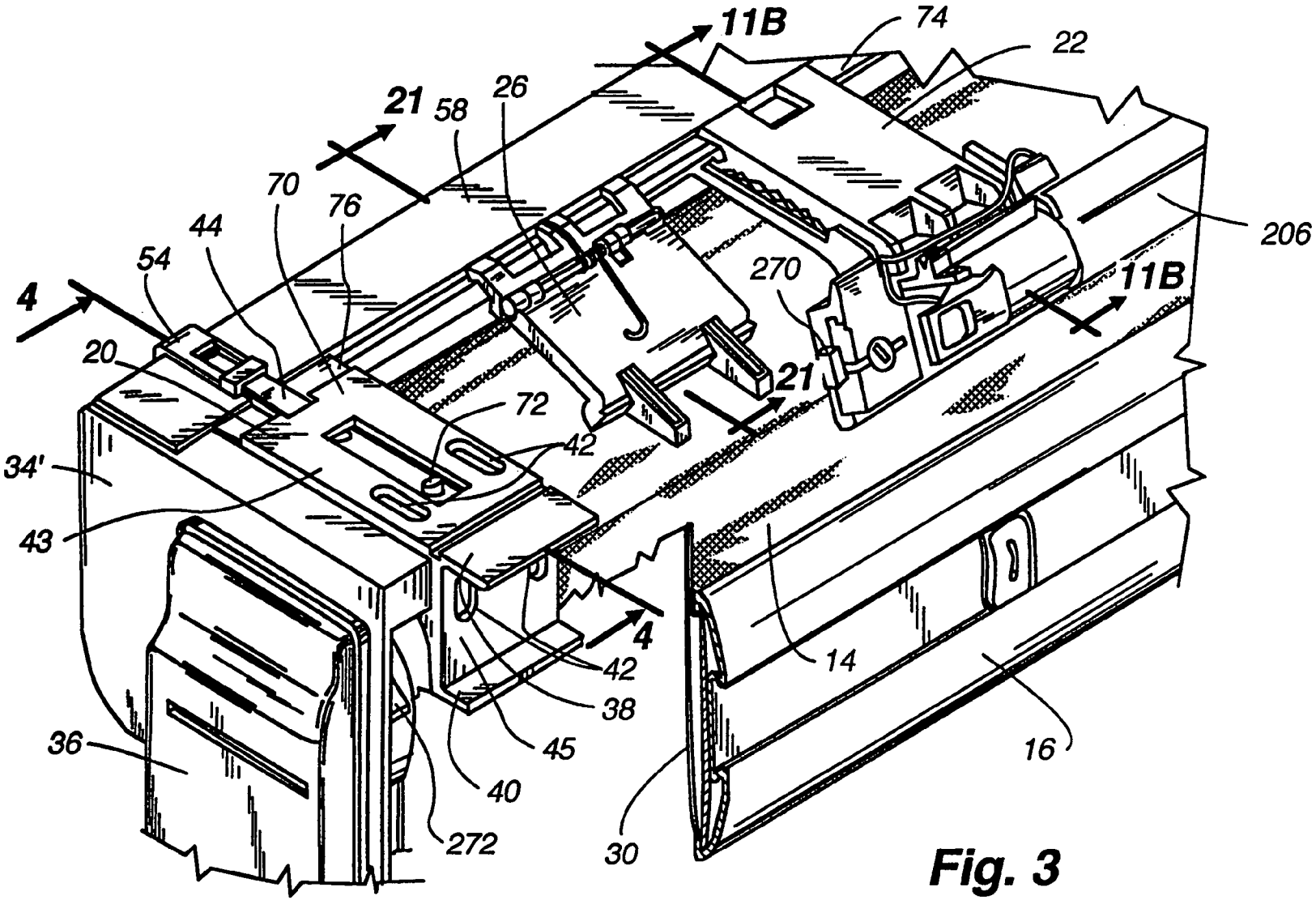
FIG. 3 is a fragmentary isometric view taken along line 3—3 of FIG. 1, depicting a section of the apparatus displayed in FIG. 1.
Figure 4:
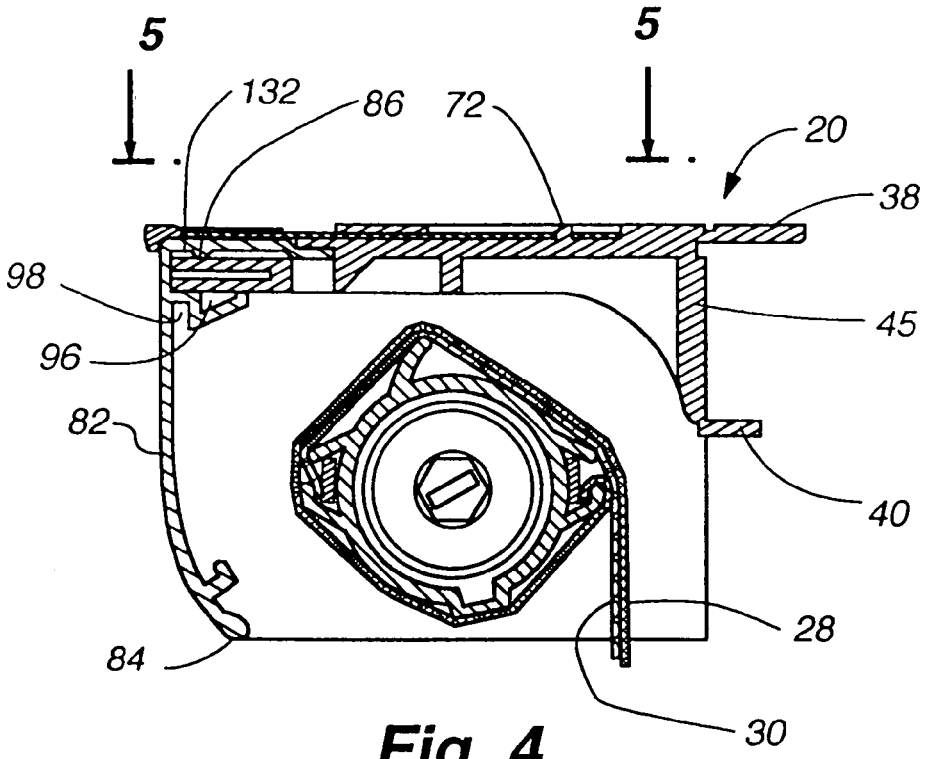
FIG. 4 is a cross-sectional view taken along line 4—4 of FIG. 3 through one of the main mounting brackets.

Referring next to FIGS. 3, 4, 5, 6, 7, and 8, details concerning the elements comprising each main mounting bracket 20 are described. FIG. 3 depicts the main mounting bracket 20 supporting the right end of the apparatus as depicted in FIG. 1. As shown in FIGS. 3 and 4, each main mounting bracket 20 includes an upper break away tab 38 and a lower break away tab 40. These upper and lower break away tabs 38, 40, respectively, may be used to properly distance the head rail 12 from the mounting surface. If the tabs 38, 40 are not required, they may be broken away from the remainder of the main mounting brackets 20. As shown to best advantage in FIG. 3, each main mounting bracket 20 comprises four adjustable mounting slots 42, two on a top surface 43 and two on a back surface 45.

Figure 8:
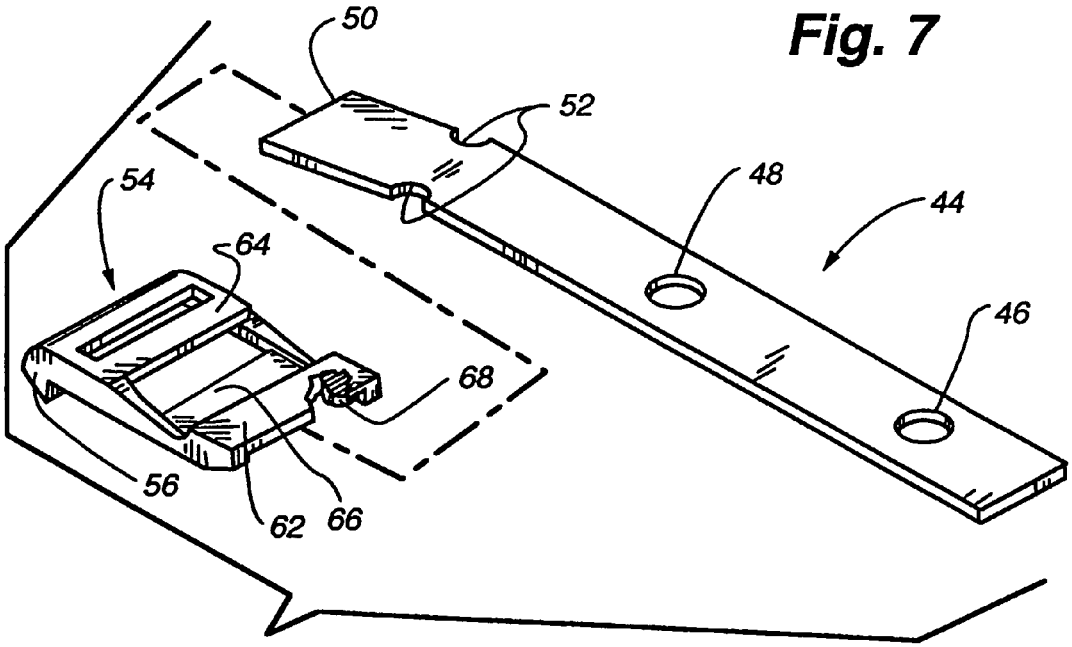
FIG. 8 is an exploded isometric view of two components comprising part of a main mounting bracket.

Mounted in the center of each main mounting bracket 20 is a pressure strip 44, which, in the preferred embodiment, is metallic. The pressure strip 44 is shown to best advantage in FIGS. 5 and 8. In FIG. 8, it is clearly shown that the pressure strip 44 includes a pair of holes including a locking tab hole 46 and a second hole 48. Near a distal end 50 of the pressure strip 44, a notch 52 is formed on each side of the pressure strip 44, and the pressure strip 44 is slightly bent downward adjacent the notches 52 on the side of the notches 52 closest to the second hole 48.

Figure 5:
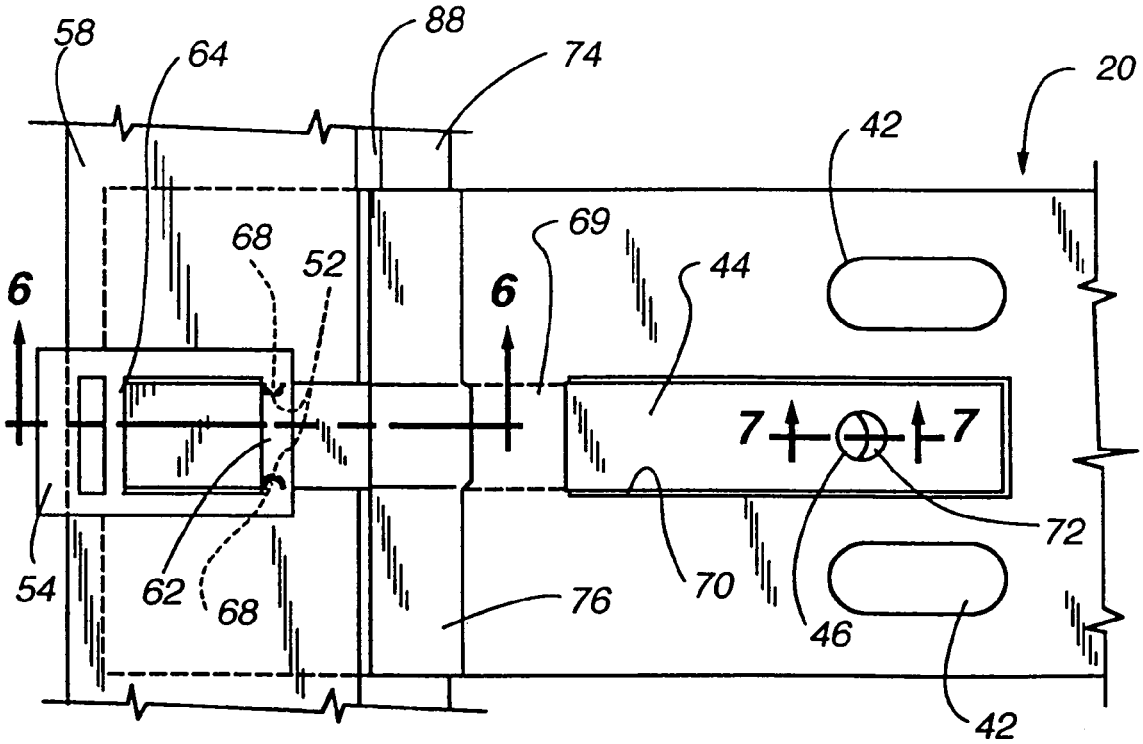
FIG. 5 is a fragmentary top view taken along line 5—5 of FIG. 4, depicting a portion of one of the main mounting brackets.
Figure 6:
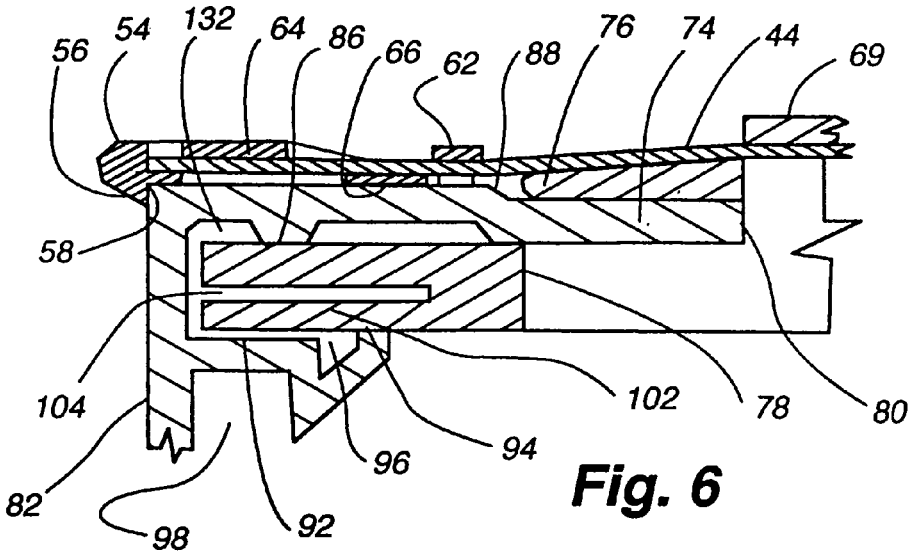
FIG. 6 is a partial cross-sectional view taken along line 6—6 of FIG. 5, depicting engagement of a main mounting bracket with the arcuate cover.
Figure 7:
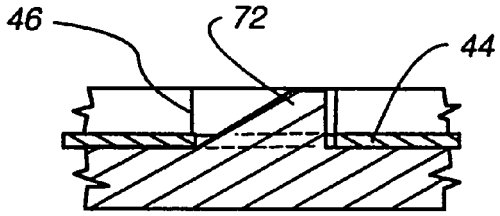
FIG. 7 is a partial cross-sectional view taken along line 7—7 of FIG. 5, depicting a locking tab engaging a pressure strip comprising a portion of a main mounting bracket.

FIG. 8 also includes an isometric view of a retention clip 54. The retention clip 54 comprises a downward projecting portion 56, which snaps over the front of a top edge 58 of an arcuate cover 60 (FIG. 1) when the mounting bracket 20 is positioned on the arcuate cover 60 (see FIGS. 3, 4, and 6). The retention clip 54 also includes a first upper guide 62, a second upper guide 64, and a lower guide 66. When the retention clip 54 is slid onto the distal end 50 of the pressure strip 44, the portion of the pressure strip 44 between its distal end 50 and the notches 52 is guided into the slot defined between the lower guide 66, and the first and second upper guides 62, 64, respectively, (see FIGS. 5 and 6). FIG. 5 shows the first and second upper guides 62, 64, respectively, in position over the top surface of the section between the distal end 50 and the notches 52. FIG. 6 shows the same relationship between the first and second upper guides 62, 64, respectively, and the section between the distal end 50 and the notches 52; and FIG. 6 also depicts the lower guide 66 of the retention clip 54 riding on the bottom surface, as depicted, of the pressure strip 44 between its distal end 50 and the notches 52 in the pressure strip 44.

As seen to best advantage in FIGS. 5 and 8, a pair of detents 68 are formed in the retention clip 54 beneath the first upper guide 62. When the pressure strip 44 is inserted into the retention clip 54, these detents 68 snap into the notches 52 in the pressure strip 44. Once the retention clip 54 is thereby retained on the distal end 50 of the pressure strip 44, the opposite end of the pressure strip 44 is inserted under a retention bridge 69 and into a slot 70 formed in the top surface 43 of the main mounting bracket 20. This slot 70 in the top surface 43 of the main mounting bracket 20 may be seen to best advantage in FIGS. 3 and 5. When the pressure strip 44 is inserted completely into the slot 70 in the top surface 43, a locking tab 72 snaps through the locking tab hole 46 in the pressure strip 44 (see FIGS. 3 and 7), thereby retaining the pressure strip 44 in the slot 70 in the top surface 43 of the main mounting bracket 20.

Once the main mounting bracket 20 is assembled by slipping the distal end 50 of the pressure strip 44 into the retention clip 54, and then slipping the opposite end of the pressure strip 44 into the slot 70 in the top surface 43 of the main mounting bracket 20, the main mounting bracket 20 may be attached to the head rail 12. As may be seen to best advantage in FIGS. 4 and 6, the main mounting bracket 20 attaches to a mounting lip 74 of the arcuate cover 60. Each main mounting bracket 20 includes an upper leg 76 and a lower leg 78 defining a slot 80 therebetween (FIG. 6). As seen to best advantage in FIG. 5, both the upper leg and the lower leg (shown in phantom) extend laterally from side-to-side of the main mounting bracket 20. When the main mounting bracket 20 is forced onto the arcuate cover 60, it snaps into and retains its position thereon. In order to more clearly understand how each main mounting bracket 20 snappingly attaches to the arcuate cover 60, several features of the arcuate cover 60 must first be described.

Figure 21:
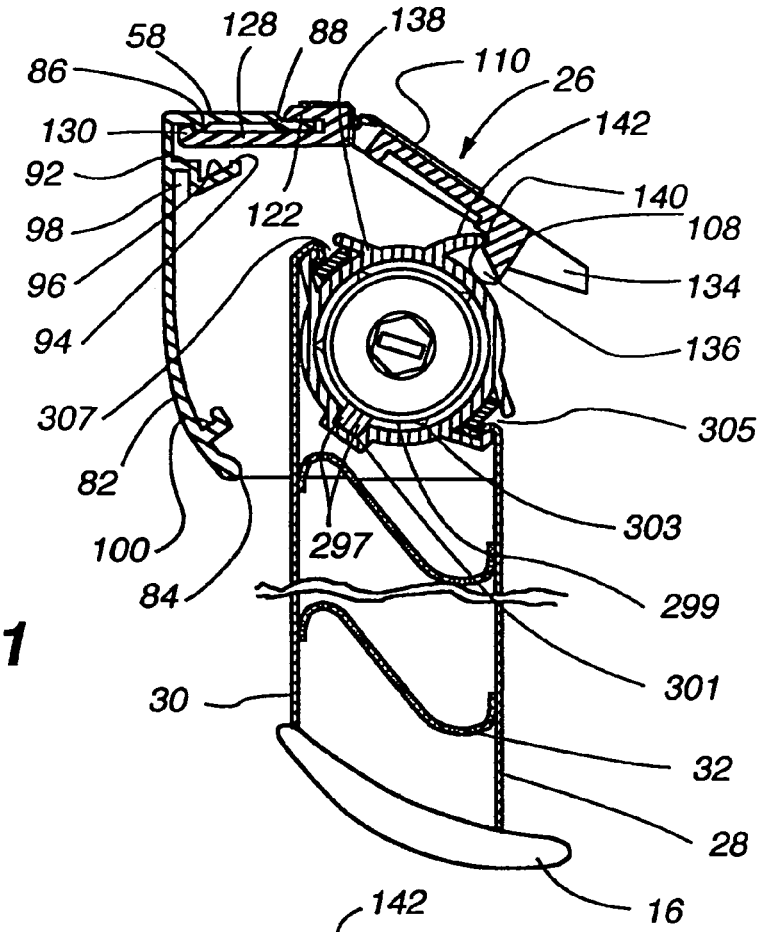
FIG. 21 is a partial cross-sectional view taken along line 21—21 of FIG. 3 through a limit stop and shows the limit stop capturing the stop rib when the retractable covering attempts to over extend.

Referring to FIGS. 4, 6, and 21, the elements of the arcuate cover 60 (labeled in FIG. 1) are described. Each of these figures shows the cross section of the arcuate cover 60. The arcuate cover 60 includes a top edge 58 that is substantially perpendicularly joined to a front surface 82 that is curved toward the covering 14 at the arcuate cover's 60 bottom edge 84. Moving toward the rear of the head rail 12 (to the right in FIGS. 4, 6, and 21) from the intersection of the top edge 58 with the front surface 82 of the arcuate cover 60 along the bottom or inside portion of the top edge 58, a downward ridge 86 is first encountered. Continuing toward the rear of the head rail 12, the top edge 58 slopes downward at a shoulder 88 to the mounting lip 74, which extends along the full longitudinal length of the back side of the top edge 58 of the arcuate covering 60. The lowest point of the downward ridge 86 and the under side of the mounting lip 74 are substantially coplanar as seen to best advantage in FIG. 6. Moving downward, as depicted, along the front surface 82 of the arcuate cover 60 from the intersection of the front surface 82 with the top edge 58, a support ledge 92 is encountered on the inside, as depicted, of the front surface 82. Continuing substantially horizontally from the support ledge 92, a support ridge 94 is next encountered. The support ledge 92 and the support ridge 94 are substantially coplanar. A sloped channel 96 is defined between the support ledge 92 and the support ridge 94. An upper trough 98 is defined below the support ledge 92 between the back side of the front surface 82 and one side of the sloped channel 96. Near the bottom edge 84 of the front surface 82 of the arcuate cover 60 a lower trough 100 is defined. The left and right end caps 34, 34', respectively, each has an arcuate portion (not shown) defined on its inside surfaces that engages the upper and lower troughs 98, 100, respectively, on the inside of the front surface 82 of the arcuate cover 60. Thus, the end caps 34, 34' are frictionally held onto the arcuate cover 60 by the upper and lower troughs 98, 100, respectively.

Referring again to FIGS. 4 and 6, attachment of the main mounting brackets 20 to the arcuate cover 60 is now described. The lower leg 78 of each main mounting bracket 20 includes a split tongue 102 having a compression slot 104 across its entire width. In other words, the compression slot 104 shown in cross section in FIGS. 4 and 6 extends through the lower leg 78 from one lateral edge of the lower leg 78 to the other lateral edge. When the mounting bracket 20 is forced onto the arcuate cover 60, the split tongue 102 portion of the lower leg 78 is inserted into the "pocket" formed by the underside of the mounting lip 74, the downward ridge 86, the support ledge 92, and the support ridge 94. Since the top-to-bottom thickness of the split tongue 102 of the lower leg 78 is slightly greater than the vertical distance between the plane defined by the downward ridge 86 and the inside of the mounting lip 74, and the plane defined by the support ledge 92 and the support ridge 94, the split tongue 102 is compressed slightly as it is inserted into the previously defined pocket. The compression slot 104 thereby decreases in size as the split tongue 102 is forced into the pocket. Since the upper and lower portions of the split tongue 102 resist this compression, this resistance helps maintain the main mounting bracket 20 in position.

While the split tongue 102 is being inserted into the above-defined pocket, the slot 80 defined between the upper leg 76 and the lower leg 78 of the main mounting bracket 20 slides over the mounting lip 74 on the top edge 58 (see FIG. 6). When the mounting lip 90 is completely seated into the slot 80, the downward projecting portion 56 of the retention clip 54 snaps over the corner of the top edge 58. The main mounting bracket 20 is thus held securely in position by the split tongue 102, slot 80, and retention clip 54. In particular, the main mounting bracket 20 cannot move further leftward in FIG. 6 because the base of the mounting lip 74 is pressing against the bottom of the slot 80, and the main mounting bracket 20 will not move rightward in FIG. 6 because of the downward projecting portion 56 of the retention clip 54. Similarly, up-and-down motion of the main mounting bracket 20 is inhibited by the interaction between the lower leg 78, the upper leg 76, the retention clip 54, and the arcuate cover 60. If it becomes desirable to remove the main mounting bracket 20 from the arcuate cover 60, the downward bias generated by the pressure strip 44 that keeps the retention clip 54 clipped over the arcuate cover 60 may be overcome by lifting upward on the retention clip 54, for example, by pressing a thumb upward against the downward projecting portion 56 of the retention clip 54 to force it onto the top edge 58 of the arcuate cover 60. When the downward projecting portion 56 of the retention clip 54 is thus disengaged from the arcuate cover 60, the main mounting bracket 20 may be pulled rightward in FIGS. 4 and 6 with sufficient force to completely remove the main mounting bracket 20 from the arcuate cover 60.

Figure 9A:
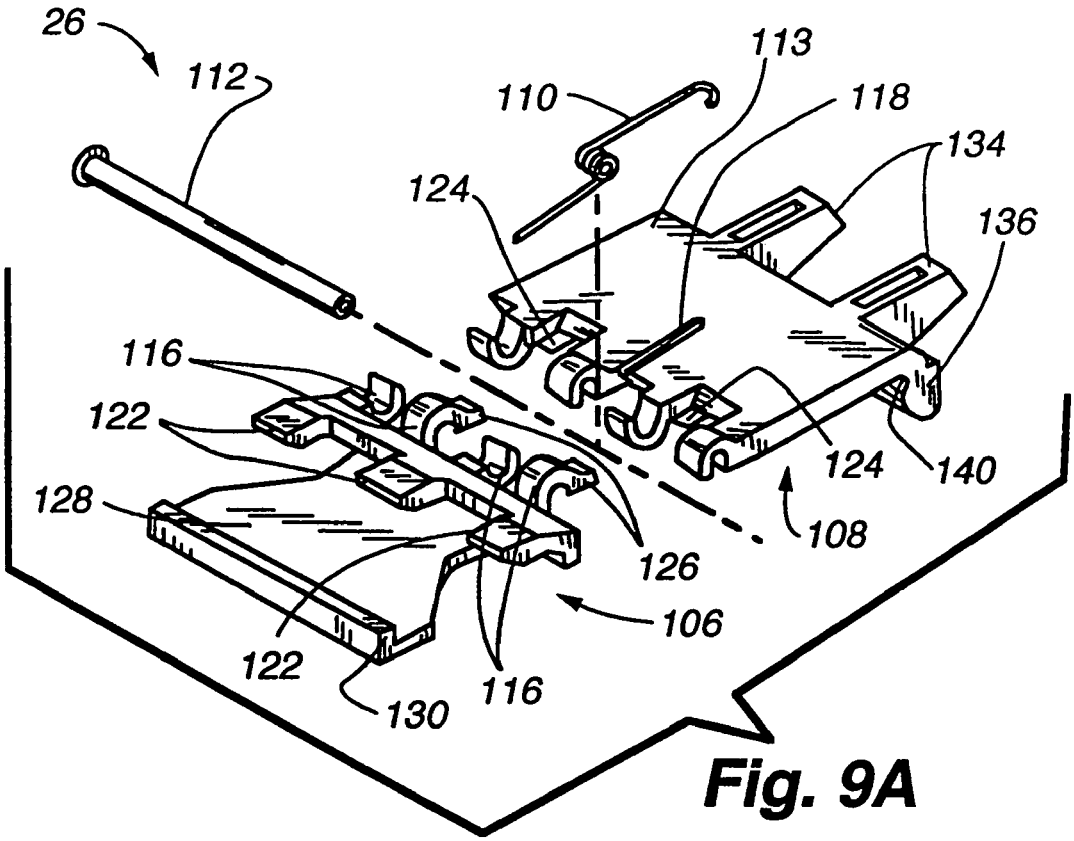
FIG. 9A is an exploded isometric view of a limit stop.

Referring next to FIGS. 1, 3, 9A, 9B, 21, 22, 23, and 24, construction of a limit stop 26 and attachment of the limit stop 26 to the arcuate cover 60 is described next. As clearly depicted in the preferred embodiment of FIGS. 1 and 3, the present invention includes two limit stops 26 that prevent over-retraction and over-extension of the covering 14. FIG. 9A is an exploded, isometric view of one limit stop 26. As shown in this figure, each limit stop 26 comprises four main components: a mounting half 106, a working half 108, a biasing spring 110, and a hinge pin 112.

Looking first at the working half 108, one edge comprises a plurality of alternating hinge portions 114. In the preferred embodiment, these hinge portions 114 each comprise approximately half of a hinge section. Corresponding hinge portions 116 are located on the mounting half 106. The hinge portions 114 on the working half 108 interlock with the hinge portions 116 on the mounting half 106, thereby forming a hinge channel to accommodate the hinge pin 112. When the mounting half 106 and the working half 108 of the limit stop 26 are assembled, the hinge pin 112 is slid through the channel defined by the hinge portions 114, 116, and the hinge pin 112 is slid through a loop in the central portion of the biasing spring 110 to maintain the spring's position between the mounting half 106 and the working half 108. A spring groove 118 is cut in the top portion, as depicted, of the main body 113 of the working half 108, and a similar spring groove (not shown) may be formed in the middle one of the retention fingers 122 on the mounting half 106. Two pivot stops 124 are mounted on the working half 108 of the limit stop 26. These pivot stops 124 comprise plate-like surfaces near the hinge edge of the working half 108. Two of the hinge portions 116 on the mounting half 106 comprise extensions 126 that impact the pivot stops 124 if the assembled limit stop 26 starts to flex too greatly in one direction about the hinge pin 112. For example, in FIGS. 9A and 21, if the mounting half 106 were held stationary and the working half 108 were rotated far enough counter-clockwise, the extensions 126 on the mounting half 106 would impact the pivot stops 124 on the working half 108 of the limit stop 26, thereby preventing excessive upward or counter-clockwise rotation of the working half 108 of the limit stop 26.

Referring to FIG. 9A, the mounting half 106 of the limit stop 26 includes three retention fingers 122 in the preferred embodiment. The retention fingers 122 are suspended above the main body 128, thereby forming a "pocket" between the main body 128 and the retention fingers 122. On a distal edge of the main body 128 is a substantially vertical projection 130.

Referring now to FIG. 21, when the mounting half 106 of the limit stop 26 is slid onto the top edge 58 of the arcuate cover 60, the substantially vertical projection 130 on the distal edge of the main body 128 snaps into an upper channel 132 (clearly visible in FIGS. 4 and 6) defined by the front surface 82 of the arcuate cover 60 and the downward ridge 86 on the underside of the top edge 58 of the arcuate cover 60, while the retention fingers 122 frictionally engage the top surface of the mounting lip 74 and the main body 128 slides under the mounting lip 74 and the downward ridge 86. The limit stop 26 is thereby attached to the arcuate cover 60 in close frictional engagement therewith.

Figure 9B:
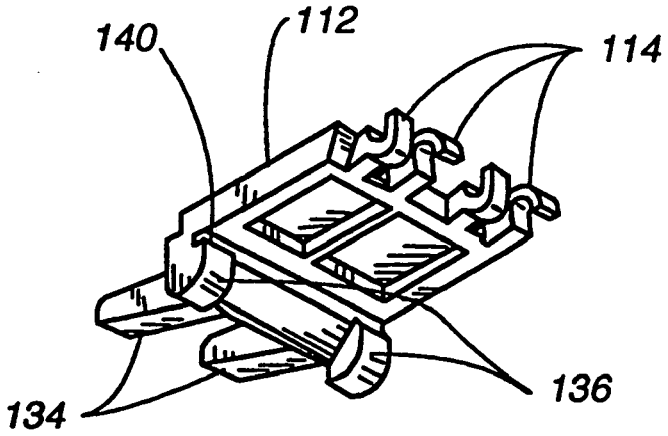
FIG. 9B is an isometric view of the underside of the working half of the limit stop depicted in FIG. 9A.

As shown in FIGS. 9A, 9B, and 21, the working half 108 of the limit stop 26 includes two bottom rail stop arms 134. The function of the bottom rail stop arms 134 will be described further below with reference to FIG. 24. The underside of the working half 108 (see FIG. 9B) includes two curvilinear portions 136, which ride on the outer surface of the covering 14 as it is rolled onto a roll bar 138 (see FIG. 23). Where these curvilinear portions 136 intersect the main body 113, a pocket 140 is defined (most clearly visible on the right-hand edge of FIG. 9A). As shown in FIG. 21, this pocket 140 helps prevent over-rotation of the roll bar 138 and over-extension of the covering 14. If, for some reason, the apparatus attempts to over extend the covering 14, a forward extending stop rib 142 of the roll bar 138 gets trapped in the pocket 140 defined behind the curvilinear portions 136 (FIG. 21). When the forward extending stop rib 142 is thus captured by the pocket 140, a motor 144 (FIG. 12) rotating the roll bar 138 is stalled, preventing over-rotation of the roll bar 138. From the direction depicted in FIG. 21, the roll bar 138 rotates clockwise during extension of the covering 14 and counter-clockwise during retraction of the covering 14.

Figure 12:
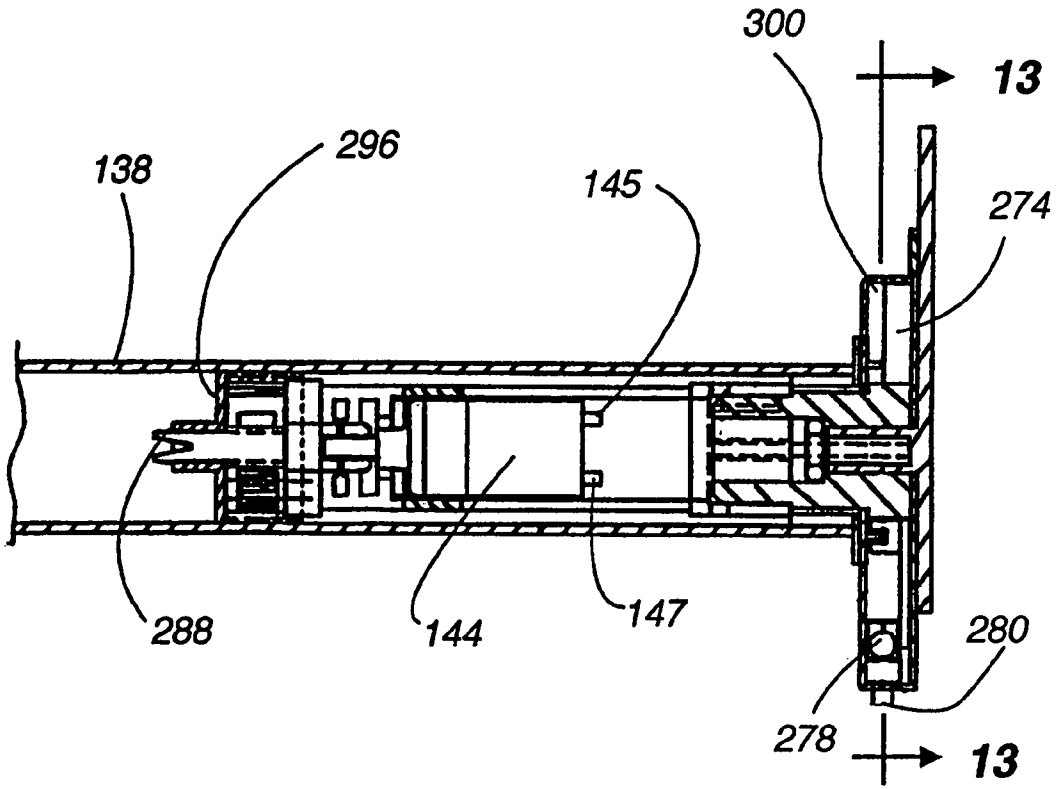
FIG. 12 is a fragmentary cross-sectional view of the drive end (the right end as depicted in FIG. 1) of the apparatus, showing placement of the gear motor.

Starting from the position shown in FIG. 21, when it is time to retract the covering 14, the roll bar 138 is caused to rotate counter-clockwise by the gear motor 144 (the gear motor is clearly visible in FIG. 12, for example). The curvilinear portions 136 of the working half 108 of the limit stop 26 are designed to permit retraction of the covering 14 even after the apparatus has attempted to overly extend the covering 14. The shape of the forwarding extending stop rib 142 also helps in this regard since it has an arched back surface that impacts the curvilinear portions 136 during retraction of the covering 14 (i.e., during the first counter-clockwise rotation of the roll bar 138 as depicted in FIG. 21).

Figure 11A:
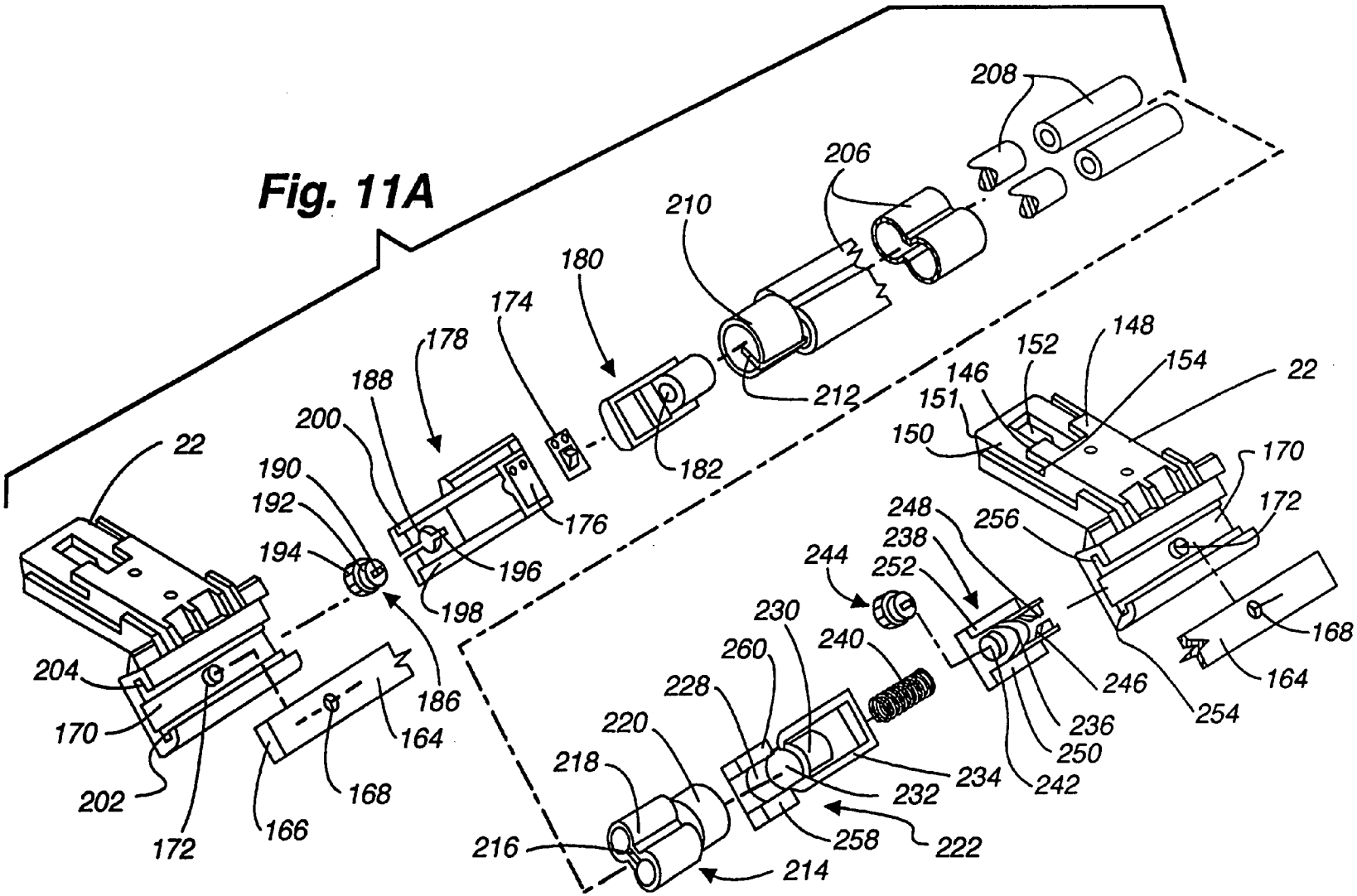
FIG. 11A is an exploded fragmentary isometric view of the power supply depicted in FIG. 10.
Figure 11B:
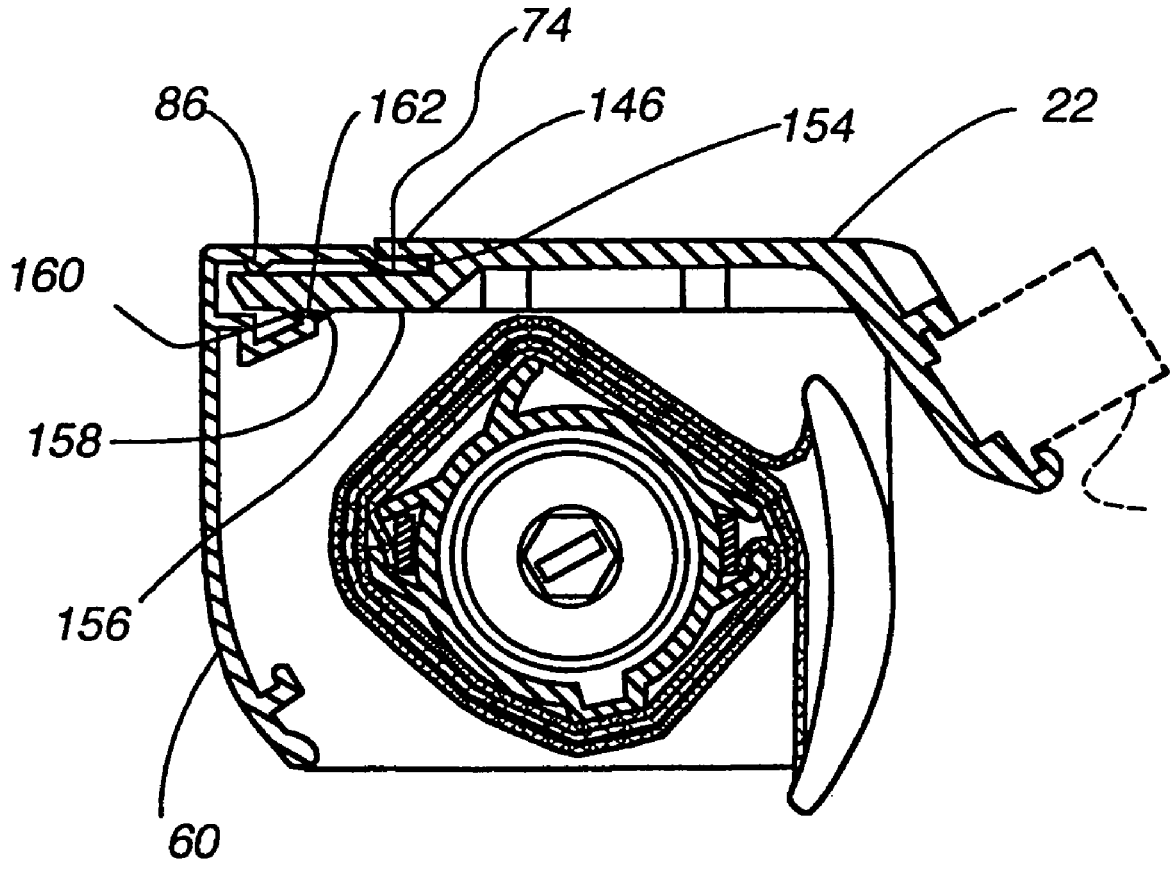
FIG. 11B is a cross-sectional view of the head rail taken along line 11B—11B of FIG. 3 through the first battery pack mounting bracket.

Referring now to FIGS. 1, 3, 11A, 11B, 11C, and 11D, attachment of the power supply 24 to the head rail 12 is described next. Referring first to FIGS. 3, 11A, and 11B, the portions of each battery pack mounting bracket 22 that mounts it to the arcuate cover 60 are described next. First and second upper legs 146, 148, respectively, extend over a substantially longer tongue 150 having a substantially rectangular port or window 152 in it (FIG. 11A). A pair of slots 154 are formed where the first and second upper legs 146, 148, respectively, intersect the base of the tongue 150 (FIG. 11A). A flexible arm 156 (FIG. 11B) extends from the side of the port 152 nearest the base of the tongue 150 and substantially fills the port 152. Near the free end of the flexible arm 156, a pair of ridges 158, 160 on the underside of the flexible arm 156 define a channel 162. When the battery mounting bracket 22 is in position on the arcuate cover 60, the tip 151 (see FIG. 11A) of the tongue 150 extends into the "pocket" defined by the downward ridge 86, the underside of the mounting lip 74, the support ledge 92, and the support ridge 94 (the support ledge 92 and the support ridge 94 are clearly shown in FIG. 6). The two slots 154 between the first and second upper legs 146, 148, respectively, and the tongue 150 frictionally engage the mounting lip 74, and the channel 162 in the flexible arm 156 captures the support ridge 94, with the second ridge 160 of the flexible arm 156 being accommodated by the sloped channel 96 integrally formed in the arcuate cover 60 (FIG. 11B).

Figure 10:
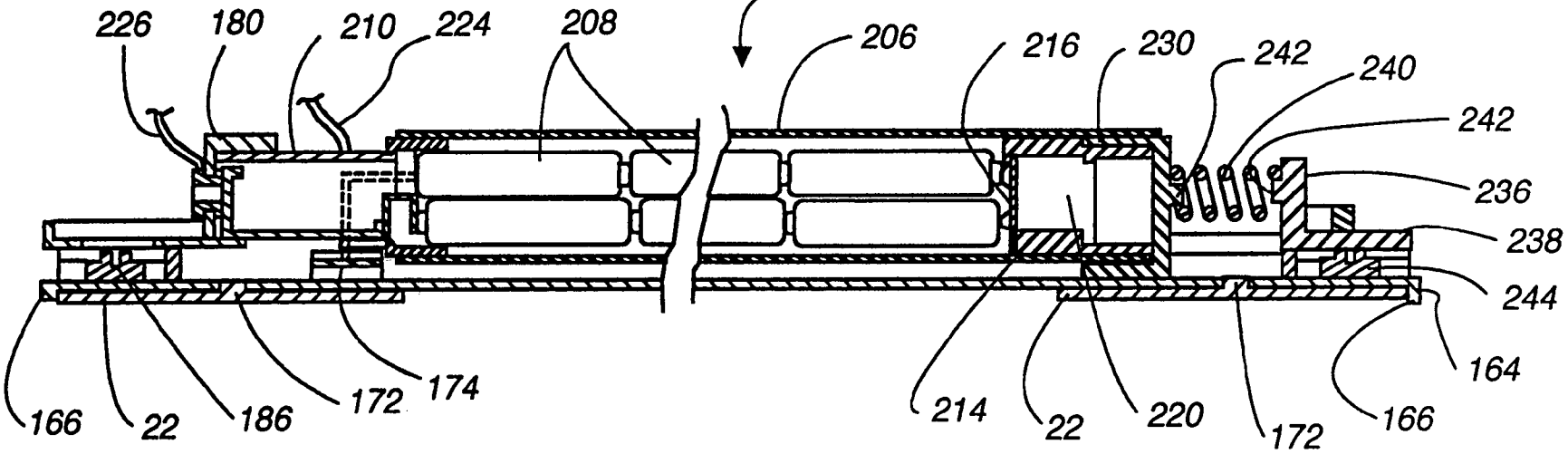
FIG. 10 is a fragmentary cross-sectional view of the power supply taken along line 10—10 of FIG. 2.

Referring next to FIGS. 1, 2, 10, 11A, 11C, and 11D, the power supply 24 and hardware for mounting it to the head rail 12 are next described. As shown to best advantage in FIGS. 1 and 2, the power supply 24 is mounted on the back side of the head rail 12 and is thereby substantially hidden from view. FIG. 11A is an exploded view of the components comprising the power supply 24. The battery pack mounting brackets 22 are attached to the arcuate cover 60 as previously described. The appropriate distance, which is a function of the length of the battery tube (or battery pack) 206 which itself is a function of the energy requirements of the control system, is established between the mounting brackets 22 using a distancing strip 164 (see FIGS. 10 and 11A). As shown in FIGS. 10 and 11A, the distancing strip 164 has a lip 166 on each end of it and a hole 168 near each end of it. The lip 166 on one end of the distancing strip 164 clips over one mounting bracket 22, while the lip 166 on the opposite end of the distancing strip 164 clips over the edge of the other battery pack mounting bracket 22. The distancing strip 164 in position with the lips 166 so arranged with respect to the battery pack mounting brackets 22 is most clearly shown in FIG. 10. A strip bed 170 (FIG. 11A) is defined in the bottom of each battery pack mounting bracket 22, and a placement pin 172 projects from the bottom of the strip bed 170. The strip bed 170 is approximately as deep as the distancing strip 164 is thick. Thereby, when the distancing strip 164 is properly placed, the placement pin 172 in each battery pack mounting bracket 22 is accommodated by the holes 168 in the distancing strip 164, and the strip bed 170 in each battery pack mounting bracket 22 is substantially filled by the distancing strip 164.

Figure 11C:
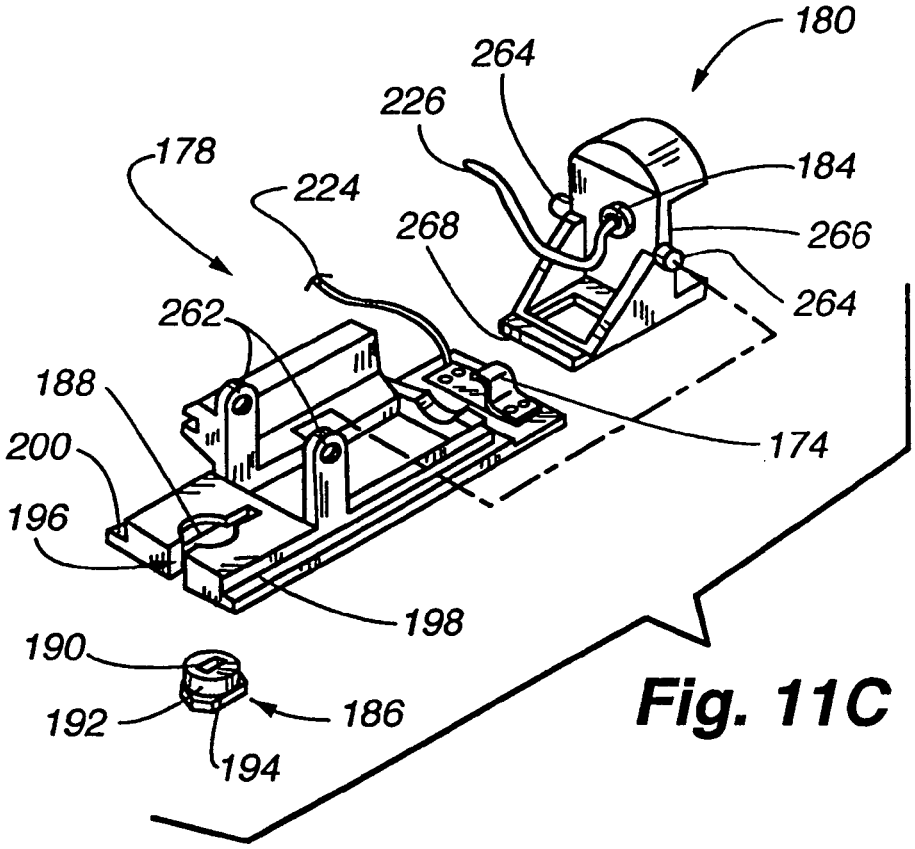
FIG. 11C is an exploded isometric view of the adjustable conductor-end anchor plate and the battery tube support piece shown in FIGS. 10 and 11A.

Once the first and second battery pack mounting brackets 22 are attached to the arcuate cover 60, and are arranged the appropriate distance apart by the distancing strip 164, the remainder of the power supply 24 may be assembled. A first conductor terminal plate 174 is attached to a conductor plate bed 176 in an adjustable, conductor-end anchor piece 178 (FIGS. 11A and 11C). The first conductor terminal plate 174 is metal, while the adjustable, conductor-end anchor piece 178 is plastic in the preferred embodiment. The first conductor terminal plate 174 may be snapped onto pins extending from the conductor plate bed 176, or it may be bolted onto the conductor plate bed 176, or the first conductor terminal plate 174 may be glued directly onto the conductor plate bed 176. Subsequently, a battery tube support piece 180 is attached to the adjustable, conductor-end anchor piece 178 (best seen in FIG. 11C). In the preferred embodiment, the battery tube support piece 180 snaps onto the adjustable, conductor-end anchor piece 178. The battery tube support piece 180 includes a conductor port 182 (FIG. 11A). A second conductor terminal plate 184 is riveted to the battery tube support piece 180 in the preferred embodiment (see FIG. 11C).

Once the adjustable, conductor-end anchor piece 178 and the battery tube support piece 180 are fixed to one another in the manner described further below, a first locking lug 186 is attached to the adjustable, conductor-end anchor piece 178. The locking lug 186 is inserted into a lug hole 188 in the adjustable, conductor-end anchor piece 178. The first locking lug 186 includes a screwdriver slot 190 in a cylindrical portion 192, and an irregular, enlarged portion 194 is adjacent the cylindrical portion 192. The lug hole 188 includes an expansion slot 196 through the center of it. When the first locking lug 186 is rotated using a screwdriver inserted into the screwdriver slot 190, the enlarged portion 194 of the first locking lug 186 tends to expand the expansion slot 196, thereby preventing the adjustable, conductor-end anchor piece 178 from sliding in the first battery pack mounting bracket 22. The adjustable, conductor-end anchor piece 178 includes a first lip 198 and a second lip 200 near its bottom surface (FIG. 11C). Once the first locking lug 186 is inserted into the lug hole 188 in the adjustable, conductor-end anchor piece 178, and after the first conductor terminal plate 174 has been attached to the adjustable, conductor-end anchor piece 178, and the battery tube support piece 180 has been attached to the adjustable, conductor-end anchor piece 178, the first lip 198 may be slid into a first groove 202 of the first battery pack mounting bracket 22, while the second lip 200 is slid into a second groove 204 of the first battery pack mounting bracket 22. When the adjustable, conductor-end anchor piece 178 is thus slid into the first battery pack mounting bracket 22, the anchor piece 178 rides on top of the distancing strip 164, thereby keeping the distancing strip 164 in its strip bed 170, and keeping the first locking lug 186 in the lug hole 188 in the anchor piece 178. Once the anchor piece 178 is positioned at a desired location, the first locking lug 186 may be rotated to expand the expansion slot 196 and thereby nonpermanently fix the anchor piece 178 to the first battery pack mounting bracket 22.

The power supply 24 on the preferred embodiment also includes a side-by-side battery tube 206, which, in the preferred embodiment, holds eight AAA batteries 208. One end of the battery tube 206 includes a fixed end cap 210 having two external conductor strips on it. The second external conductor 212 is visible in FIG. 11A. The opposite end of the battery tube includes a removable end cap 214 having a conductive strip 216 on its inner surface to connect the four batteries 208 in one side of the battery tube 206 in series with the four batteries 208 on the opposite side of the battery tube 206. The removable end cap 214 also includes a figure eight portion 218, which fits into an end of the side-by-side battery tube 206 until the conductive strip 216 contacts the batteries 208 in the battery tube 206. The removable end cap 214 also includes a cylindrical portion 220 that is cradled by a compression spring slider piece 222 (see FIG. 11D). When the fixed end cap 210 of the battery tube 206 is properly inserted into the battery tube support piece 180, the external conductors on the fixed end cap 210 make electrical contact with the first and second conductor terminal plates 174, 184, respectively (both may be seen in FIG. 11C). In particular, the second external conductor 212 on the fixed end cap 210 makes electrical contact with the second conductor terminal plate 184, which is riveted to the conductor port 182 in the battery tube support piece 180. Similarly, the first external conductor on the fixed end cap 210 makes electrical connection with the first conductor terminal plate 174 mounted in the conductor plate bed 176 of the adjustable, conductor-end anchor plate 178. As shown in FIG. 11C, a first wire lead 224 is soldered to the first conductor terminal plate 174, and a second wire lead 222 is soldered to the second conductor terminal plate 184.

Figure 11D:
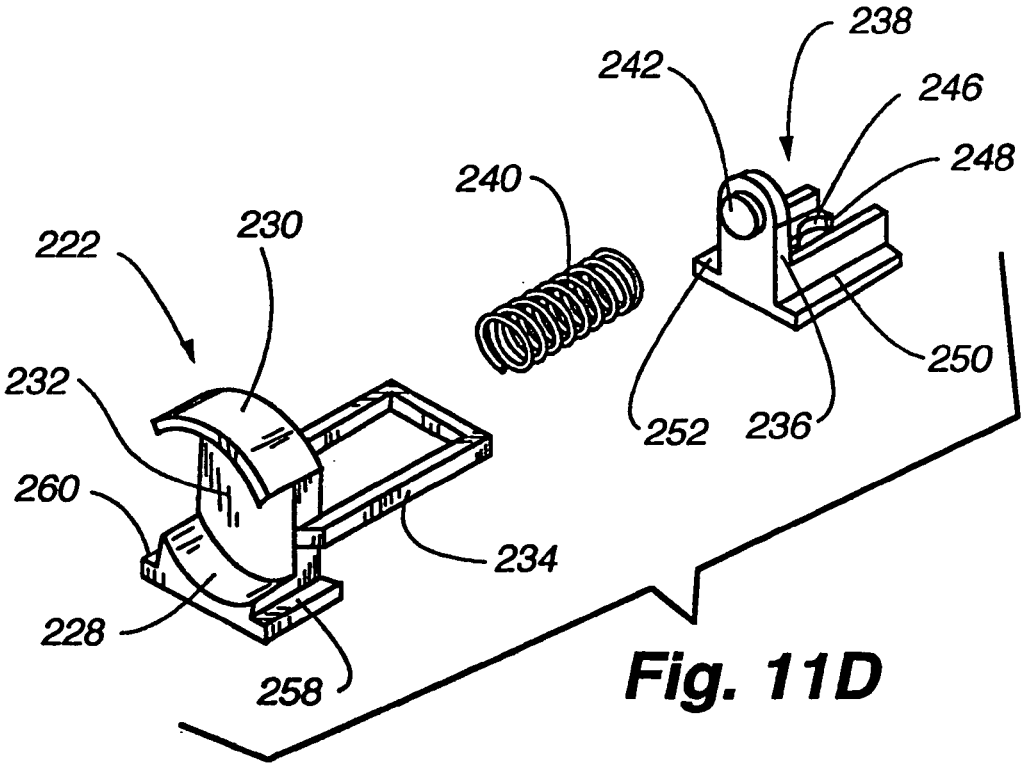
FIG. 11D is an exploded isometric view of the compression spring slider piece and the compression spring anchor piece shown in FIGS. 10 and 11A.

The cylindrical portion 220 of the removable end cap 214 is supported by the compression spring slider piece 222 (FIGS. 10 and 11D). The compression spring slider piece 222 includes an arcuate support surface 228 that cradles the cylindrical portion 220 of the removable end cap 214. An arcuate outer wall 230 also engages the cylindrical portion 220 of the removable end cap 214. An abutment surface 232 extends between the arcuate support surface 228 and the arcuate outer wall 230, and this abutment surface 232 presses against the end of the removable end cap 214, holding it in position.

One side of the compression spring slider piece 222 includes a range-limiting bracket 234. The range-limiting bracket 234 extends around and behind an upright wall 236 of a compression spring anchor piece 238. A compression spring 240 maintains pressure between the compression spring anchor piece 238 and the compression spring slider piece 222. The compression spring slider piece 222 and the compression spring anchor piece 238 each includes a spring-mounting pin 242 having an outside diameter that is substantially the same size as the inside diameter of the compression spring 240. The compression spring 240 may be thereby slid onto the spring-mounting pins 242.

To assemble the three primary components that support the removable end cap 214, a second locking lug 244 (which is the same as the first locking lug 186 in the preferred embodiment) is inserted into a lug hole 246 in the compression spring anchor piece 238. This lug hole 246 (visible in FIGS. 11A and 11D) similarly is divided by an expansion slot 248 in the base of the compression spring anchor piece 238. The compression spring anchor piece 238 includes a first lip 250 and a second lip 252. The first lip 250 is slidably engaged in a first groove 254 of the second battery pack mounting bracket 22, while the second lip 252 of the compression spring anchor piece 238 is slidable engaged in a second groove 256 of the second battery pack mounting bracket 22. Since the first and second battery pack mounting brackets 22 are the same in the preferred embodiment, the first groove 254 of the second battery pack mounting bracket is the same as the first groove 202 of the first battery pack mounting bracket. Similarly, the second groove 256 of the second battery pack mounting bracket is the same as the second groove 204 of the first battery pack mounting bracket. When the anchor piece 238 is thus slid into the second battery pack mounting bracket 22, the underside (not labeled) of the anchor piece 238 keeps the distancing strip 164 in the strip bed 170 of the second battery pack mounting bracket 22, and the second locking lug 244 is held in the lug hole 246. The compression spring slider piece 222 also includes a first lip 258 and a second lip 260. The compression spring 240 is slid over the mounting pin 242 of the anchor piece 238, and then the first and second lips 258, 260, respectively, of the compression spring slider piece 222 are slid into the first and second grooves 254, 256, respectively, of the second battery pack mounting bracket 22, while ensuring that the range-limiting bracket 234 is placed around the upright wall 236 of the compression spring anchor piece 238. Once the anchor piece 238 and the slider piece 222 are each inserted into the grooves 254, 256 of the second battery pack mounting bracket 22, and the compression spring 240 is properly placed between these two pieces 238, 222, they may be placed in a desired position along the first and second grooves 254, 256, respectively. Once the anchor piece 238 is properly positioned, a screwdriver blade is inserted into the screwdriver slot of the second locking lug 244, and the second locking lug 244 is rotated to spread the expansion slot 248 and thereby hold the compression spring anchor piece 238 in the desired position in the first groove 254 and second groove 256 of the second battery pack mounting bracket 22. The compression spring anchor piece 238 thereby also keeps the compression spring slider piece 222 from falling out of the first groove 254 and second groove 256 of the second battery pack mounting bracket 22.

If the slider piece 222 slides in a first direction, it eventually compresses the compression spring 240 enough that the slider piece 222 cannot slide any further in the first direction. If, on the other hand, the slider piece 222 slides in the opposite direction, the range-limiting bracket 234 eventually gets caught by the upright wall 236 of the compression spring anchor piece 238. When the removable end cap 214 is properly mounted to the end of the battery tube 206, it may be slid into the compression spring slider piece 222. In order to insert the battery tube 206 into position, it may be necessary to manually force the slider piece 222 toward the anchor piece 238, thereby compressing the compression spring 240 to provide sufficient space to slip the cylindrical portion 220 of the removable end cap 214 into frictional engagement with the arcuate support surface 228 and the arcuate outer wall 230 of the compression spring slider piece 222. When the compression spring 240 is permitted to force the compression spring slider piece 222 away from the compression spring anchor piece 238, the pressure generated by the spring 240 maintains the battery tube 206 in the desired position between the battery tube support piece 180 and the compression spring slider piece 222.

FIGS. 11C and 11D show details concerning the hardware that support the ends of the battery tube 206 depicted in FIG. 11A. Referring first to FIG. 11C, details concerning the adjustable, conductor-end anchor plate 178 and the battery tube support piece 180 are described next. FIG. 1C shows details of the two pieces that support the fixed end cap 210 of the battery tube 206, namely the adjustable, conductor-end anchor piece 178 and the battery tube support piece 180. The conductor-end anchor piece 178 includes a conductor plate bed 176 integrally formed therein (see FIG. 11A for a clear view of the conductor plate bed 176). As shown in FIG. 11C, the first conductor terminal plate 174 is mounted in the conductor plate bed 176, and a first wire lead 224 is soldered to the first conductor terminal plate 174. Near the mid section of the conductor end anchor piece 178 are two upright support arms 262, each having a hole in its distal end (see FIG. 11C). These substantially vertical upright support arms 262 flex outward slightly so that the holes in the support arms 262 will snap over the mounting pins 264 on the battery tube support piece 180 when the battery tube support piece 180 is snapped into position.

On the left end of the conductor-end anchor piece 178, as depicted in FIG. 11C, is a lug hole 188 and expansion slot 186, which are both integrally formed in the conductor-end anchor piece 178. The lug hole 188 rotatably accommodates the cylindrical portion 192 of the first locking lug 186. The bottom side (not shown) of the conductor-end anchor piece 178, below the lug hole 188 shown in FIG. 11C, is cut out to accommodate the enlarged portion 194 of the first locking lug 186. The cylindrical portion 192 has a screwdriver slot 190 formed therein. When the first locking lug 186 is positioned in the lug hole 188 and a screwdriver is used to rotate the locking lug 186, the enlarged portion 194 of the locking lug 186 expands the expansion slot 196 in a known manner to force the first lip 198 and second lip 200 apart. Thus, when the first lip 198 of the conductor-end anchor piece 178 is in the first groove 202 of the first battery pack mounting bracket 22 and the second lip 200 is in the second groove 204 of the first battery pack mounting bracket 22, rotation of the locking lug 186 nonpermanently fixes the position of the conductor-end anchor plate 178 relative to the first battery pack mounting bracket 22.

The battery tube support piece 180 includes a pair of mounting pins 264 that are pivotally accommodated by the substantially vertical upright support arms 262 of the conductor-end anchor piece 178. The mounting pins 264 are positioned below the conductor port 182 (visible in FIG. 11A) of the battery tube support piece 180. The mounting pins 264, which define the pivot axis of the battery tube support piece 180 are also mounted below the center of the abutment surface 266 of the support piece 180 (the center of the abutment surface 266 roughly corresponds to the position of the conductor port 182, which has the second conductor terminal plate 184 riveted to it in FIG. 11C). Thus, when the fixed end cap 210 of the battery tube 206 is positioned against the abutment surface 26 of the battery tube support piece 180, pressure exerted by the fixed end cap 210 against the abutment surface 266 tends to rotate the battery tube support piece 180, if at all, counterclockwise about the mounting pins 264 depicted in FIG. 11C. This counterclockwise rotation of the battery tube support piece 180 in the holes in the upright support arms 262 of the conductor-end anchor piece 178 rotates the trailing edge 268 of the support piece 180 against the surface of the conductor-end anchor piece 178.

As clearly shown in FIG. 11C, the second conductor terminal plate 184 is riveted in the conductor port 182 (visible in FIG. 11A), and the second wire lead 226 is soldered to the second conductor terminal plate 184, which is visible in FIG. 11C. When the battery tube 206 is correctly positioned in the battery tube support piece 180, and the battery tube support piece 180 is snapped into position in the conductor-end anchor piece 178, the batteries 208 in the battery tube 206 are connected in series with the first wire lead 224 and the second wire lead 226. The first and second lead wires 224, 226, respectively, are then connected to a plug 270, which may be seen in FIG. 3. Once the power supply 24 is positioned on the back of the head rail 12, the plug 270 on the end of the first wire lead 224 and the second wire lead 226 is plugged into a power connection port 272 visible in, for example, FIGS. 3 and 14.

Focusing now on FIG. 11D, the details concerning the hardware components that support the removable end cap 214 of the battery tube 206 are described next. The compression spring anchor piece 238 includes a lug hole 246 divided by an expansion slot 248. The lateral edges of the bottom portion of the anchor piece 238 comprises a first lip 250 and a second lip 252. When the anchor piece 238 is correctly positioned in the second battery pack mounting bracket 22 (FIG. 11A), the first lip 250 rides in the first groove 254 and the second lip 252 rides in the second groove 256. Once the anchor piece 238 is correctly positioned in the second battery pack mounting bracket 22, the locking lug 244 is rotated in the lug hole 246 to expand the expansion slot 248 and frictionally bind the anchor piece 238 in the second battery pack mounting bracket 22. The anchor piece 238 also includes a substantially vertical upright wall 236 that has a spring mounting pin 242 integrally formed thereon. Once the anchor piece 238 is properly positioned, the compression spring 240 may be slipped onto the spring mounting pin 242 of the anchor piece 238. The spring mounting pin 242 is designed to frictionally fit into the inside of the compression spring 240. The compression spring slider piece 222 is next positioned in the second battery pack mounting bracket 22 by placing the range-limiting bracket 234 around the upright wall 236 of the compression spring anchor piece 238 and slipping the first lip 258 and the second lip 260 on the bottom lateral edges of the slider piece 222 into the first groove 254 and second groove 256 on the second battery pack mounting bracket 22.

The side of the abutment surface 232 that is not visible in FIG. 11D has a spring mounting pin like the pin 242 integrally formed on the compression spring anchor piece 238. This spring mounting pin rides inside the opposite end of the compression spring 240, thereby trapping the compression spring 240 between the compression spring anchor piece 238 and the compression spring slider piece 222. When thus mounted, the compression spring slider piece 222 is prevented from sliding off the second battery pack mounting bracket 22 by the interaction between the range-limiting bracket 234 and the upright wall 236, and the interaction between the first lip 258 and second lip 260 of the slider piece 222 in the first groove 254 and second groove 256, respectively, of the second battery pack mounting bracket 22.

The slider piece 222 may, however, slide toward and away from the compression spring anchor piece 238 a predetermined amount by applying varying amounts of pressure to the abutment surface 232 and thereby compressing the compression spring 240 or permitting it to expand. The arrangement depicted in FIG. 11D thereby maintains longitudinal pressure on the battery tube end caps 210, 214, which enhances the battery tube's ability to maintain a complete electrical circuit.

Figure 13:
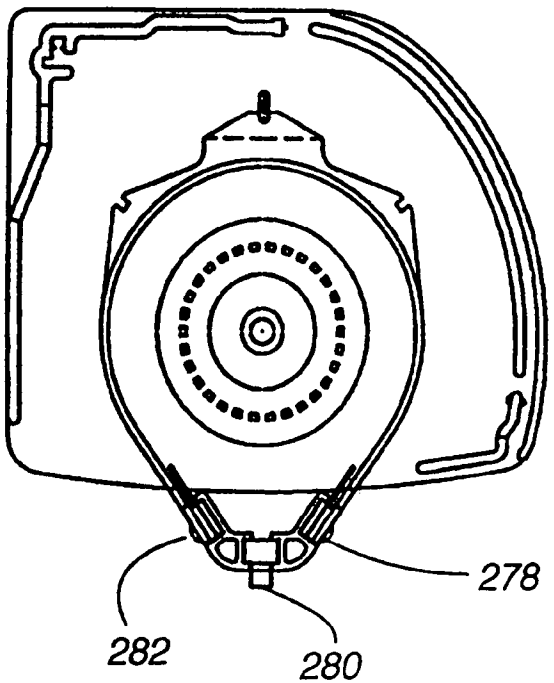
FIG. 13 is a cross-sectional view taken along line 13—13 of FIG. 12.

FIG. 12 shows a cross-sectional view of the gear motor 144 and the circuit board housing 274, which protects a circuit board 276 (see FIG. 16) that controls operation of the gear motor 144. In the preferred embodiment, the gear motor 144, which is powered through first and second power terminals, 145, 147, respectively, is a reversible, direct current (dc) motor. Also shown in FIG. 12 is a signal receiver 278 and a manual operation switch 280. As shown in FIG. 13, the circuit board housing 274 includes ports that accommodate the signal receiver 278 and a plug 282. Depending upon the particular mounting of the retractable covering 14, the signal receiver 278 and the plug 282 may be interchanged to facilitate the clearest line of sight from the remote control 18 to the signal receiver 278.

Figure 15:
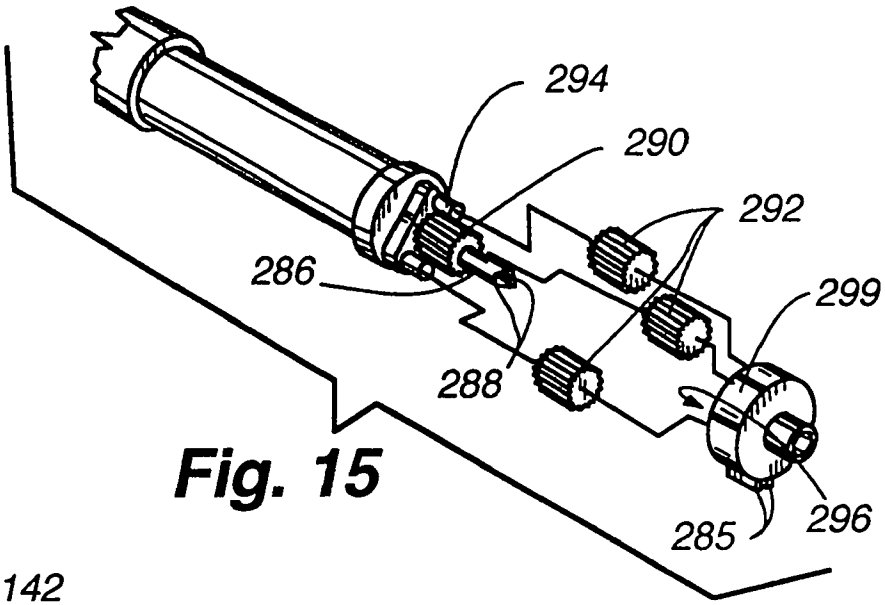
FIG. 15 is an exploded isometric view of the gears driven by the gear motor.
Figure 14:
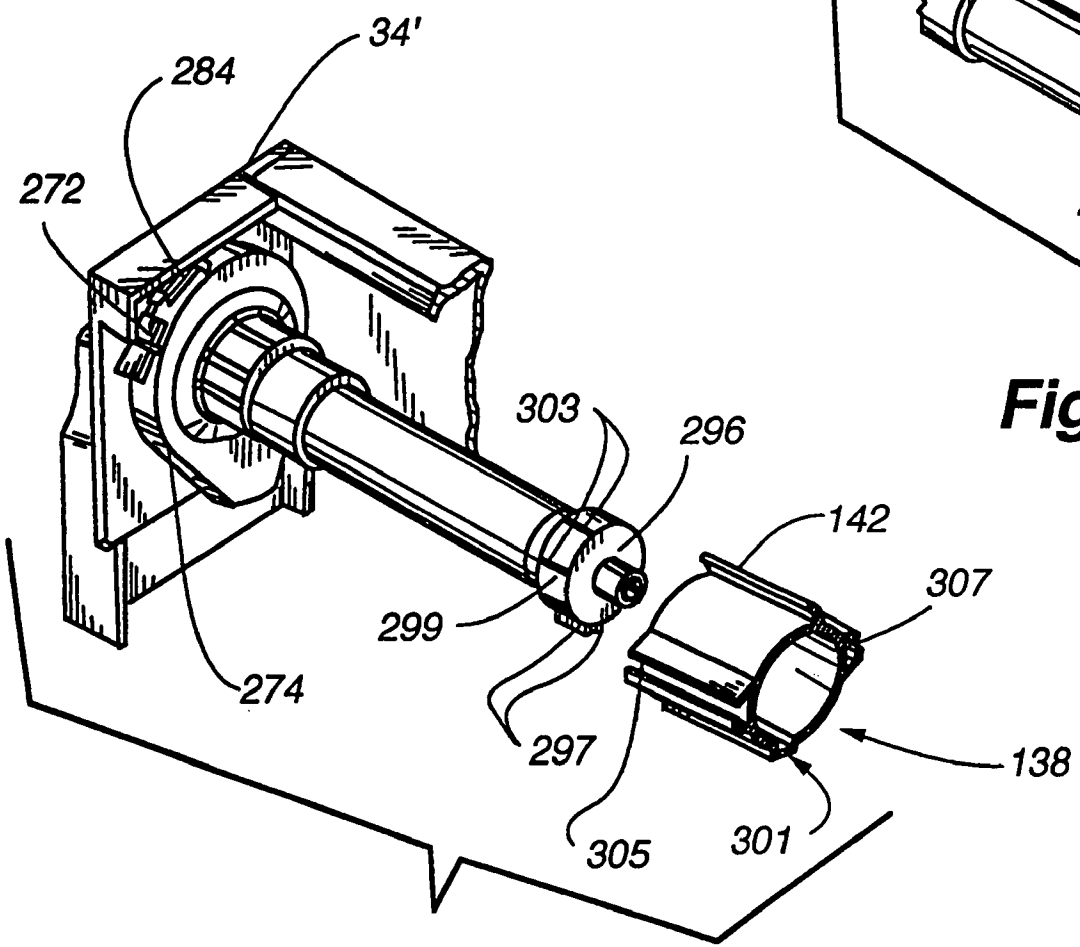
FIG. 14 is an exploded isometric view of the back side of the drive end taken along line 14—14 of FIG. 1.

Referring now to FIGS. 14 and 15, additional details concerning the drive end of the head rail 12 are visible. A power connection port 272 is visible in FIG. 14. When the power supply 24 is properly mounted on the head rail 12 as previously described, a plug 270 (visible in FIG. 3) connected to the first wire lead 224 and the second wire lead 226 is plugged into the power connection port 272 shown adjacent the circuit board housing 274 in FIG. 14. The power connection port 272 is connected by a ribbon cable 284 to the circuit board 276 inside of the circuit board housing 274.

The gear motor 144 shown in FIG. 12 has a gear shaft 286 attached to it. The gear shaft 286 is clearly visible in FIG. 15. The distal end of the gear shaft includes a pair of locking tabs 288. Surrounding a portion of the gear shaft 286 is a motor gear 290. In the preferred embodiment, the motor gear 290 comprises fifteen teeth or splines. In the preferred embodiment, three orbiting transfer gears 292 slide onto corresponding dowels or pivot pins 294 mounted at equal intervals around the motor gear 290 so as to meshingly engage the motor gear 290. In the preferred embodiment, the orbiting transfer gears 292 each comprises twenty-one teeth or splines. Subsequently, an internal gear 296 is slid over the orbiting transfer gears 292 so that the internal gear 296 meshes with the three orbiting transfer gears 292. In the preferred embodiment, the internal gear 296 comprises fifty-eight teeth or splines. When the internal gear 296 is sufficiently slid onto the orbiting transfer gears 292, the pair of locking tabs 288 on the distal end of the gear shaft 286 retain the internal gear 296 in position. As shown to good advantage in FIGS. 14 and 15 (see also FIGS. 21 and 22), the internal gear 296 has extended ribs 297 on its outer surfaces 299. These extended ribs 297 ride in an alignment channel 301 comprising part of the roll bar 138. Thus, when the gear motor 144 drives the internal gear 296, that in turn drives the roll bar 138 through the interaction between the extended ribs 297 and the alignment channel 301. A plurality of smaller ribs 303 ride on the inner surface of the roll bar 138 when it is mounted on the internal gear 296.

Figure 16:
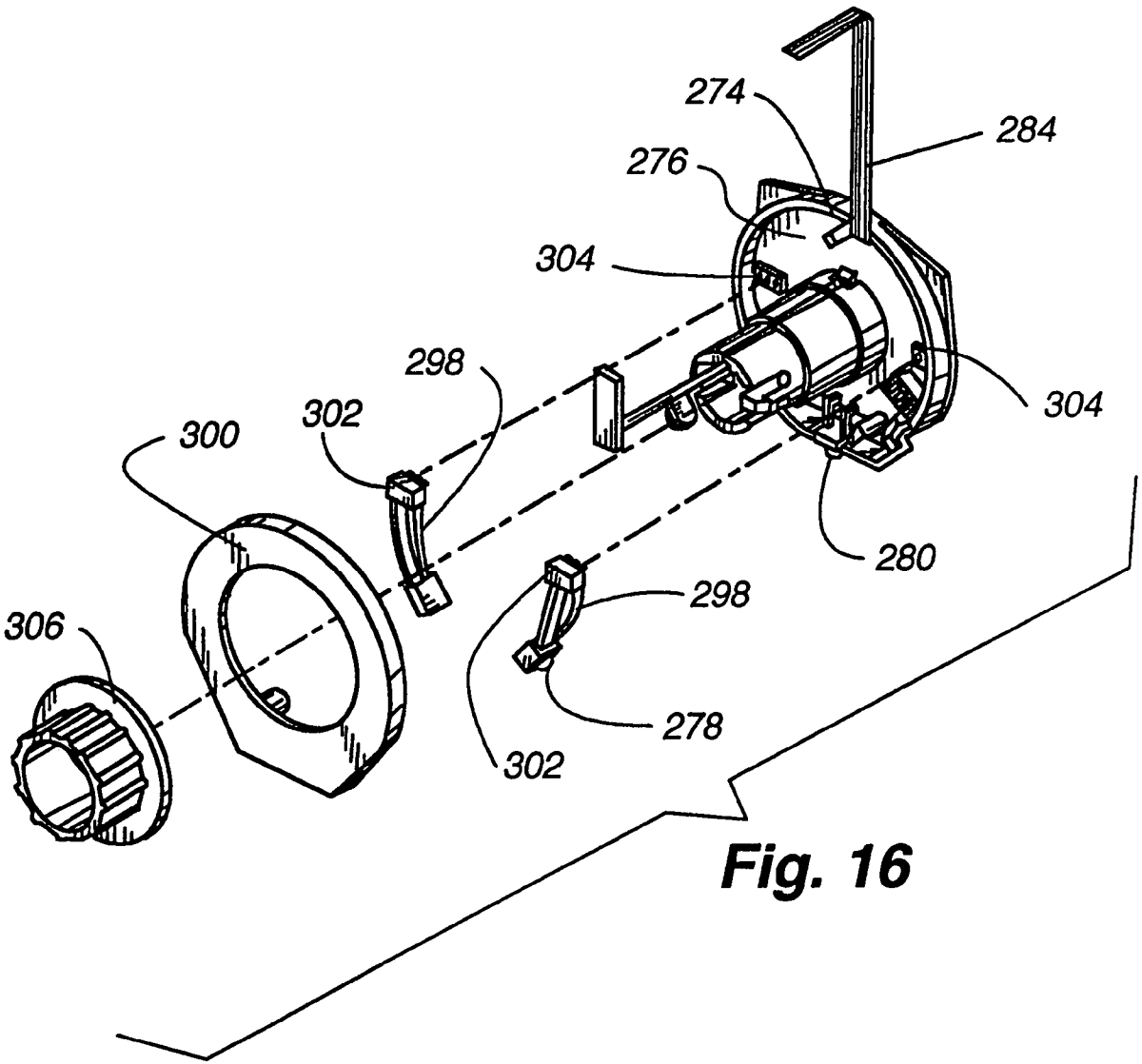
FIG. 16 is an exploded isometric view of the circuit board housing and components attached thereto.

FIG. 16 is an exploded isometric view of the circuit board 276 in the circuit board housing 274. Clearly visible in FIG. 16 is the signal receiver 278 and the signal receiver wiring 298 shown in two selectable positions. The signal receiver 278 may be mounted in either side of a circuit board housing cover 300, depending upon the intended mounting location for the covering 14. In the preferred embodiment, the signal receiver wiring 298 has a plug 302 soldered to it that plugs into an appropriate socket 304 on the circuit board 276. The ribbon cable 284 that joins the circuit board 276 to the power connection port 272 (FIG. 14) may be seen in FIG. 16. Also, a rotator counter 306 that provides required position information to the electronics may be seen in FIG. 16.

Figure 18:
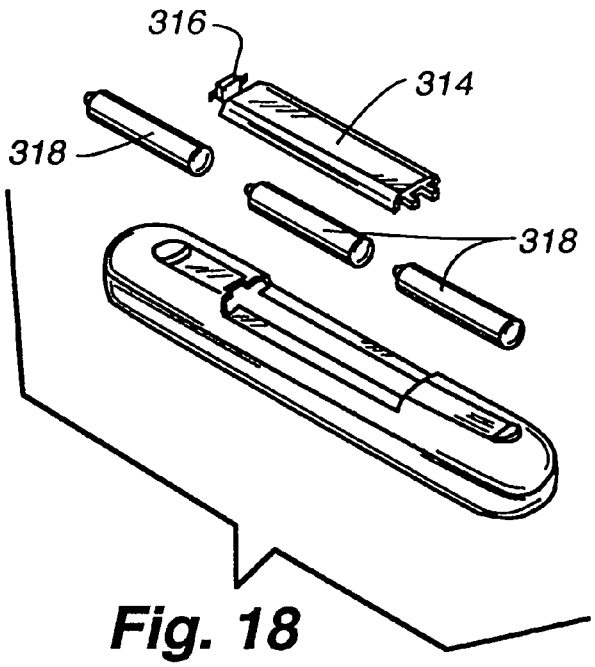
FIG. 18 is an exploded isometric view of the back side of the remote control depicted in FIG. 17.
Figure 17:
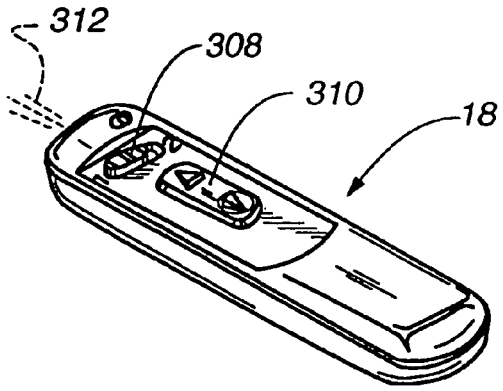
FIG. 17 is an isometric view of the top side of the remote control.
Figure 19:
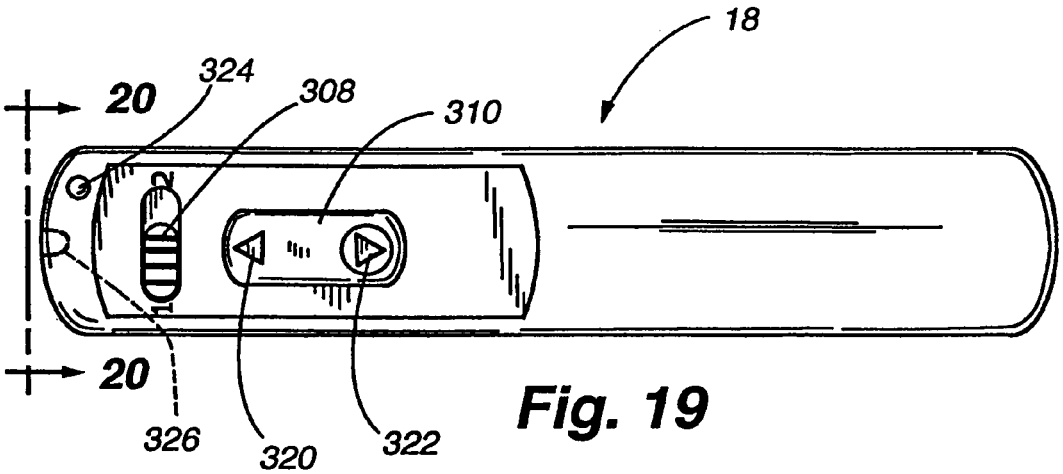
FIG. 19 is a top planform view of the remote control depicted in FIG. 17.
Figure 20:
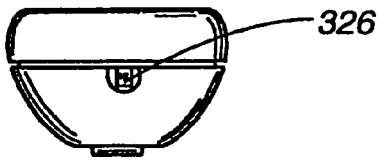
FIG. 20 is an end view of the remote control depicted in FIG. 19 taken along line 20—20 of FIG. 19.

FIGS. 17, 18, 19, and 20 show the primary features of the remote control 18. FIG. 17 is an isometric view of the top surface of the remote control 18. Clearly visible in FIG. 17 is a frequency selection switch 308. In the preferred embodiment, it is possible to select one of two control frequencies so that more than one retractable covering 14 may be separately controlled by a single remote control 18. Mounted just below the frequency selection switch 308, as depicted, is a control rocker switch 310. Also shown in FIG. 17 is a control signal 312 emanating from the end of the remote control 18. FIG. 18 is an exploded isometric view of the back side of the remote control 14 showing a battery housing cover 314 and a locking tab 316 that holds the battery housing cover 314 in position over the three AAA batteries 318 used by the remote control 18 in the preferred embodiment. FIG. 19 is a top view of the remote control 18 and shows further details of the control switches. In particular, the control rocker switch 310 includes a raised up arrow 320 and a recessed down arrow 322. Since the up arrow 320 is slightly raised and the down arrow 322 is slightly recessed, it is possible to use the remote control 18 in low light or no light conditions. Also visible in FIG. 19 is a transmission indicator LED 324. When the up arrow 320 or down arrow 322 on the rocker switch 310 is pressed, the transmission indicator LED 324 lights so that the user knows that the remote control 18 is attempting to transmit a signal 312 to the receiver 278 mounted in the head rail 12. Finally, FIG. 20 shows an end view of the remote control 18 along line 20—20 of FIG. 19. Clearly visible in FIG. 20 is the control signal transmitter port 326 (this port is also shown in phantom in FIG. 19). The control signal 312 emanates from the transmitter port 326. Thus, the transmitter port 326 must be aimed at the receiver 278 during transmission.

FIG. 21 depicts the limit stop 26 operating to prevent the roll bar 138 from over-rotating and thereby over-extending the covering 14. As previously discussed, if the gear motor 144 attempts to over-extend the covering 14, the forward extending stop rib 142 will engage the pocket 140 defined by the main body 113 and the curvilinear portion 136 of the working half 108 of the limit stop 26. The locking engagement between the forward extending stop rib 142 and the pocket 140 prevents the roll bar 138 from continuing to rotate. When the roll bar 138 is thus stopped from rotating, the electronics continue to command the drive motor 144 to rotate the roll bar 138, but no rotation results. After a short duration, the electronics realize that the gear motor 144 is stalled and command the gear motor 144 to stop attempting to extend the covering 14. FIG. 21 also clearly shows a first sheet-retention channel 305 retaining the first flexible sheet 28, and a second sheet-retention channel 307 retaining the second flexible sheet 30.

Figure 22:
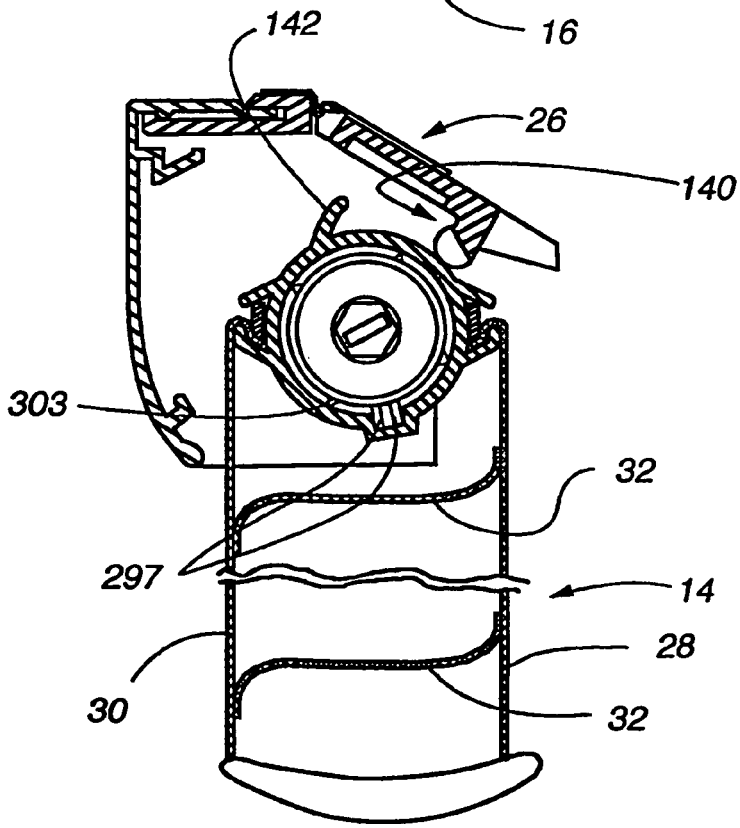
FIG. 22 is a view similar to FIG. 21 and shows the relative position of a limit stop with respect to the roll bar when the covering is in a normal, fully extended and fully open configuration.

When the control system is commanded to retract the covering 14, the forward extending stop rib 142 is easily rotated out of engagement (counterclockwise in FIG. 21) with the pocket 140 on the underside of the limit stop 26 and, as the covering 14 is wound around the roll bar 138, it rolls over the top of the forward extending stop rib 142, thereby covering it. When the covering 14 is not fully extended, the forward extending stop rib 142 is covered or concealed by the covering 14. Thus, if the system is commanded to extend the covering 14, and the covering 14 is not yet fully extended, the curvilinear portions 136 of the stop limit 26 slide over the exterior surface of the covering 14, and the forward extending stop rib 142 does not and cannot become trapped in the pocket 140 behind the curvilinear portions 136. When the control system is operating properly, the forward extending rib 142 does not get caught in the pocket 140 since the control system commands extension of the covering 144 to stop before it attempts to over-rotate the roll bar 138 and over-extend the covering 14. This latter, more typical, operation of the control system is shown in FIG. 22.

The general operation of the remotely-controllable the retractable covering 10 of the present invention is described next. The covering 14 may be in the configuration depicted in FIG. 24, which is in its most retracted configuration. From this fully retracted configuration, the operation of the remotely-controllable retractable covering 10 proceeds as follows. If the down arrow 322 on the remote control 18 is pressed and released one time, the gear motor 144 begins to drive the roll bar 138 to extend the covering 14 (i.e., clockwise as depicted in FIGS. 21–24). If no additional buttons are pressed on the remote control 18, the motor 144 continues to drive the roll bar 138 until the covering 14 is fully extended, but in a minimum transmissivity configuration (i.e., the vanes 32 between the first flexible sheet 28 and the second flexible sheet 30 are blocking the maximum amount of light and air transmission through the covering). This configuration is not shown separately in the figures, but the bottom rail 16 would be in a position similar to that depicted in FIG. 23, and the covering 14 would be otherwise filly extended. Then, if the down arrow 322 is pressed and released a second time while the covering 14 is in the fully extended configuration, the gear motor 144 again rotates the roll bar 138 (clockwise as depicted in FIG. 21) until the bottom rail 16 is horizontal and the transmissivity through the covering 14 is at a maximum (i.e., the vanes 32 between the first flexible sheet 28 and the second flexible sheet 30 are in a substantially horizontal configuration). This configuration of the covering 14 is shown in FIG. 22. When the blind is in the resulting "fully opened" configuration, any further pressing of the down arrow 322 on the remote control 18 has no effect on the configuration of the covering 14.

If, instead, the up arrow 320 on the remote control 18 is pressed and released one time while the covering 14 is in its fully opened configuration (the FIG. 22 configuration), the gear motor 144 rotates the roll bar 138 until the covering 14 is in its "fully closed" configuration (i.e., until the vanes 32 between the first flexible sheet 28 and the second flexible sheet 30 are substantially vertical and block the maximum amount of light or air attempting to pass through the covering 14). This latter configuration change involves rotating the roll bar 138 in a counterclockwise direction as depicted in FIG. 21. The covering 14 then remains in its fully extended but minimally transmissive configuration until another button 320, 322 is pressed on the remote control 18. If the up arrow 320 is again pressed and released, the gear motor 144 is commanded to drive the roll bar 138 until the covering 14 is in its fully retracted configuration (shown in FIG. 24), which is the configuration from which operation of the retractable covering commenced in this example.

Whenever the covering 14 is in motion, that motion may be interrupted by pressing and releasing either the up arrow 320 or the down arrow 322 on the remote control 18. The up-and-down operation of the covering 14 and the transmissivity-adjustment of the covering 14 may both be interrupted by pressing either the up arrow 320 or the down arrow 322 on the remote control 18. For example, if the gear motor 144 has been commanded to extend the covering 14, and the bottom rail 16 is traveling downward but has not yet reached its lowest point of travel (see FIG. 23), if either the up arrow 320 or the down arrow 322 on the remote control 18 is pressed and released, the gear motor 144 is commanded to cease all motion of the covering 14. If the down arrow 322 is then pressed and released, the gear motor 144 will be commanded to continue extending the covering 14. If, on the other hand, the up arrow 320 is pressed and released after the covering 14 was stopped, the gear motor 144 will be commanded to reverse the direction of rotation of the roll bar 138, and will begin to retract the covering 14 onto the roll bar 138 (i.e., the roll bar 138 will be rotated in the counterclockwise direction as depicted in FIGS. 21–24). Similarly, if the covering 14 is being retracted and the up arrow 320 or the down arrow 322 is pressed and released, retraction of the covering 14 stops. Then, if the up arrow 320 is pressed and released again, retraction of the covering 14 commences. If, on the other hand, the down arrow 322 is pressed and released after stopping the retraction of the covering 14, the gear motor 144 will begin to rotate the roll bar 138 so as to extend the covering 14.

Transmissivity of the extended covering 14 is also fully adjustable using the remote control 18. When the covering 14 is in its fully extended configuration, the transmissivity of the covering 14 (i.e., the amount of light or air that is permitted to pass through the covering 14) may be adjusted by selectively pressing and releasing either the up arrow 320 or the down arrow 322. When the covering 14 is in its fully extended configuration, the gear motor 144 operates in a second, slower speed. Therefore, the transmissivity adjustments take place at the slower speed. The counter 306 used to determine the position of the covering 14 commands the gear motor 144 to operate at the slower speed for a predetermined number of counts from the fully extended configuration of the covering 14. The counter 306 is thus able to inform the gear motor 144 via the circuit board 276 when the covering 14 is configured for maximum transmissivity, minimum transmissivity, or any desired level of transmissivity between the maximum and the minimum.

Figure 24:
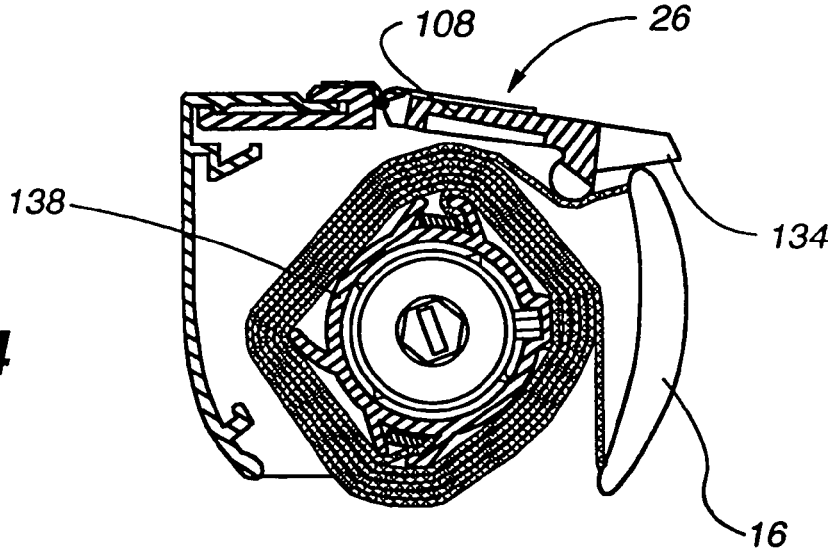
FIG. 24 is a cross-sectional view of the head rail similar to FIG. 23, but wherein the covering is in its fully retracted configuration.
Figure 23:
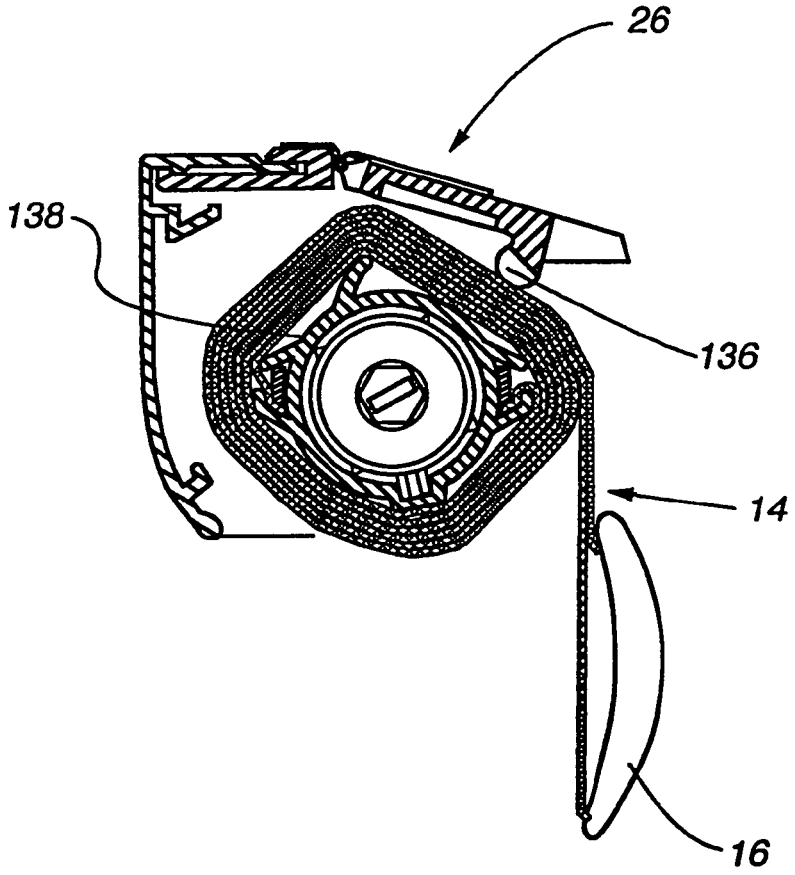
FIG. 23 is a cross-sectional view of the head rail through a limit stop as the bottom rail is drawn upward toward the head rail as the covering approaches a fully retracted configuration.

The control system of the present invention uses counting as a primary means of controlling the position and orientation of the bottom rail 16 relative to the head rail 12. In certain situations, the control system may place the gear motor 144 into a stall as a means of determining what configuration the covering 14 is in. For example, if the gear motor 144 attempts to over-extend the covering 14, as depicted in FIG. 21, the forward extending stop rib 142 on the roll bar 138 will engage the pocket 140 behind the curvilinear portion 136 of the working half 108 of the limit stop 26. If such capture of the forward extending stop rib 142 occurs, the gear motor 144 is thereby placed in a stall, which informs the circuitry that the gear motor 144 is attempting to over-rotate the roll bar 138 and over-extend the covering 144. After being in a stall for a short period, the gear motor 144 is instructed to stop attempting to rotate the roll bar 138. A second scenario where the gear motor 144 may be placed into a stall occurs when the covering 14 is fully retracted, as shown in FIG. 24. As shown, in the fully retracted configuration, an edge of the bottom rail 16 strikes the bottom rail stop arms 134 on the working half 108 of the limit stop 26. This interaction between the bottom rail 16 and the stop arms 134 accomplishes two goals. First, when the gear motor 144 rotates the roll bar 138 sufficiently to drive an edge of the bottom rail 16 into the stop arms 134, the curvilinear portions 136 on the underside, as depicted in FIG. 9B, of the working half 108 of the limit stop 26 are thereby raised off the roll bar 138 and the covering material 14 that has collected thereon. Second, when the bottom rail 16 is captured by the bottom rail stop arms 134, the gear motor 144 ultimately goes into a stall, and the control electronics recognize the stall and shut down the gear motor 144. Thus, the covering 14 takes on its fully retracted configuration, wherein the bottom rail 16 holds the working half 108 of the limit stop 26 off of the actual covering material 14, which prevents the curvilinear portions 136 which ride on the covering material 14 as it is retracted or extended from creasing or denting, which may otherwise occur if the covering 14 is kept in a fully retracted configuration over an extended period of time.

It is also possible to control the retractable covering apparatus of the present invention without using the remote control 18. A manual operation switch 280 is mounted to the circuit board housing 274 and circuit board housing cover 300 (see FIGS. 12 and 13, for example). Selective pressing of the manual operation switch 280 permits a user to configure the covering 14 in any desired configuration that is obtainable through use of the remote control 18. In general, with each press of the manual operation switch 280, the control electronics on the circuit board 276 treat each press of the manual operation switch 280 as first a press of the up arrow 320 on the remote control 18 followed by a press of the down arrow 322 on the remote control 18, or vice versa. In other words, each time the manual operation switch 280 is pressed, the control electronics interpret that as alternating presses of the up arrow 320 and down arrow 322 on the remote control 18. An exception to this general rule by which the control electronics interpret the presses of the manual operation switch 280 occurs when the covering 14 is in its fully extended configuration. When the covering 14 is in the fully extended configuration, the control electronics must determine whether the user is attempting to retract the covering 14 or merely adjust the transmissivity of the fully extended covering 14. For example, if the covering 14 is in its fully extended configuration and its minimally transmissive configuration (i.e., the covering 14 has just reached its fully extended configuration and stopped), a subsequent press of the manual operation switch 280 is interpreted by the control electronics as a command to "open" the extended covering 14, increasing the transmissivity thereof by rotating the roll bar 138 to move the vanes 32 to a more horizontal configuration. If the manual operation switch 280 is again pressed during adjustment of the transmissivity, the gear motor 144 is signaled to stop movement. If the covering 14 is thus placed in a configuration somewhere between its maximally transmissive configuration and its minimally transmissive configuration, a subsequent press and release of the manual operation switch 280 will either increase the transmissivity or decrease the transmissivity depending upon whether the transmissivity was increasing or decreasing when the manual operation switch 280 was pushed to stop motion of the gear motor 144. If the transmissivity was being increased when the gear motor 144 was commanded to stop rotating the roll bar 138, a subsequent press and release of the manual operation switch 280 will instruct the control electronics to command the gear motor 144 to continue increasing the transmissivity as long as the maximum transmissivity configuration had not yet been achieved. If, on the other hand, the transmissivity was being reduced when the manual operation switch 280 was pressed to stop rotation of the roll bar 138, a subsequent press and release of the manual operation switch 280 will cause the control electronics to instruct the gear motor 144 to rotate the roll bar 138 to continue decreasing the transmissivity until the minimum transmissivity configuration is obtained or the manual operation switch 280 is again pressed, whichever occurs first.

In summary, if the manual operation switch 280 is pressed while the gear motor 144 is rotating the roll bar 138 and the covering 14 has not yet reached a fully extended or fully retracted configuration, the gear motor 144 will be commanded to stop rotating the roll bar 138. A subsequent press and release of the manual operation switch 280 will reverse the direction of rotation of the roll bar 138.

For example, if the covering 14 was being extended before the gear motor 144 was instructed to stop rotating the roll bar 138, a subsequent press and release of the manual operation switch 280 will result in the gear motor 144 rotating the roll bar 138 so as to retract the covering 14. On the other hand, if the gear motor 144 was driving the roll bar 138 so as to retract the covering 14 when the manual operation switch 280 was pressed to stop retraction of the covering 14, a subsequent press and release of the manual operation switch 280 will cause the control electronics to command the gear motor 144 to rotate the roll bar 138 so as to extend the covering 14. When the covering 14 is in the fully extended configuration (see FIGS. 1 and 22), pressing and releasing the manual operation switch 280 does not necessarily reverse the direction of rotation of the roll bar 138. The direction of rotation of the roll bar 138 is only reversed if the transmissivity has reached a maximum before the manual operation switch 280 is pressed and released two times. For example, if the transmissivity is being increased, but has not yet reached the maximum transmissivity configuration, when the manual operation switch 280 is pressed and released, rotation of the roll bar 138 stops. If the manual operation switch 280 is again pressed and released, the roll bar 138 is rotated in the same direction that it was previously rotating until the maximum transmissivity configuration is obtained. Thus, the direction of rotation of the roll bar 138 is not always reversed following an interruption or stopping of the motion of the roll bar 138 while adjusting transmissivity (i.e., while the covering 14 is in its fully extended configuration).

Figure 25A:
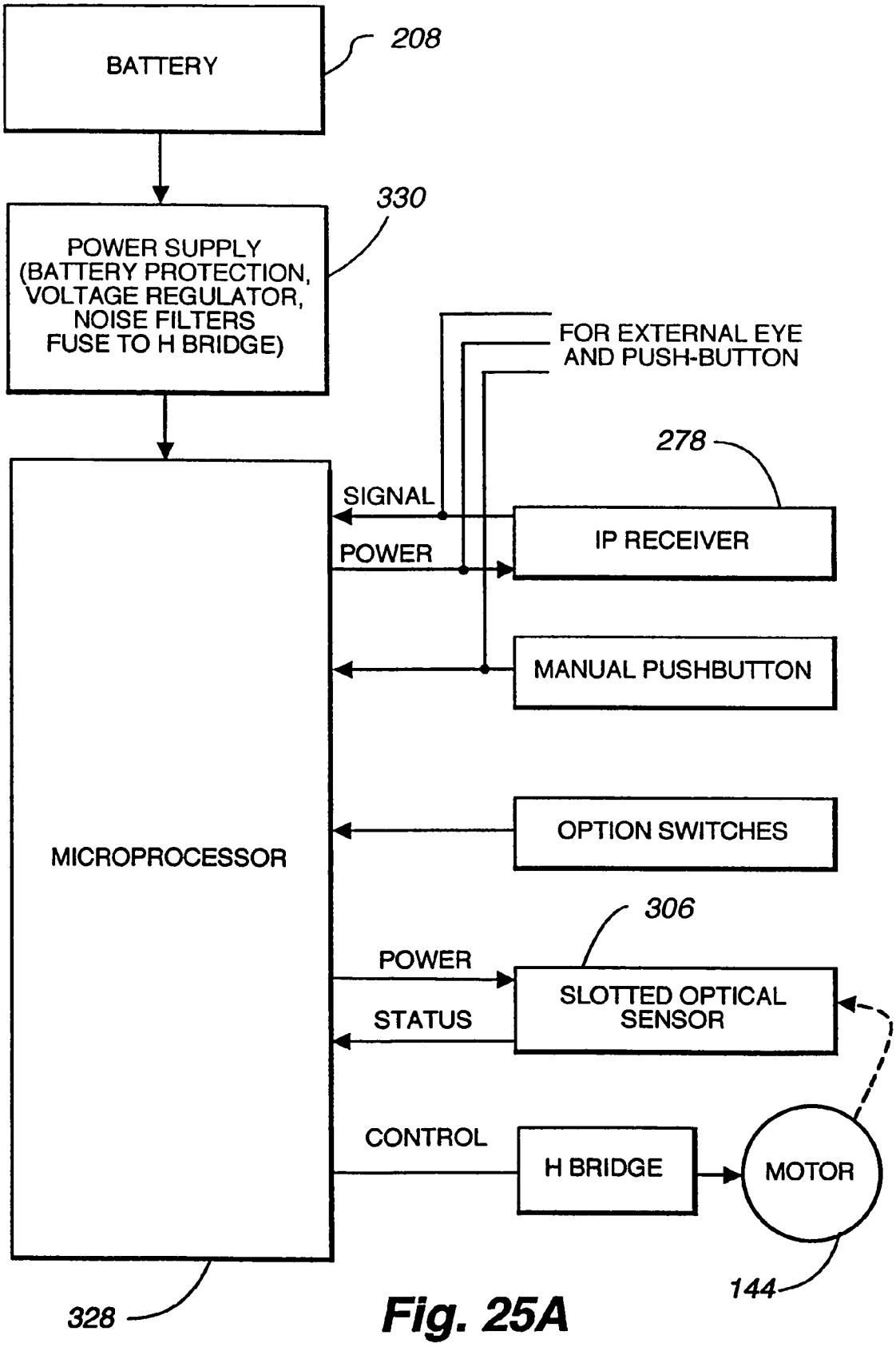
FIG. 25A is a block diagram of the remotely-controllable operating system.
Figure 25B:
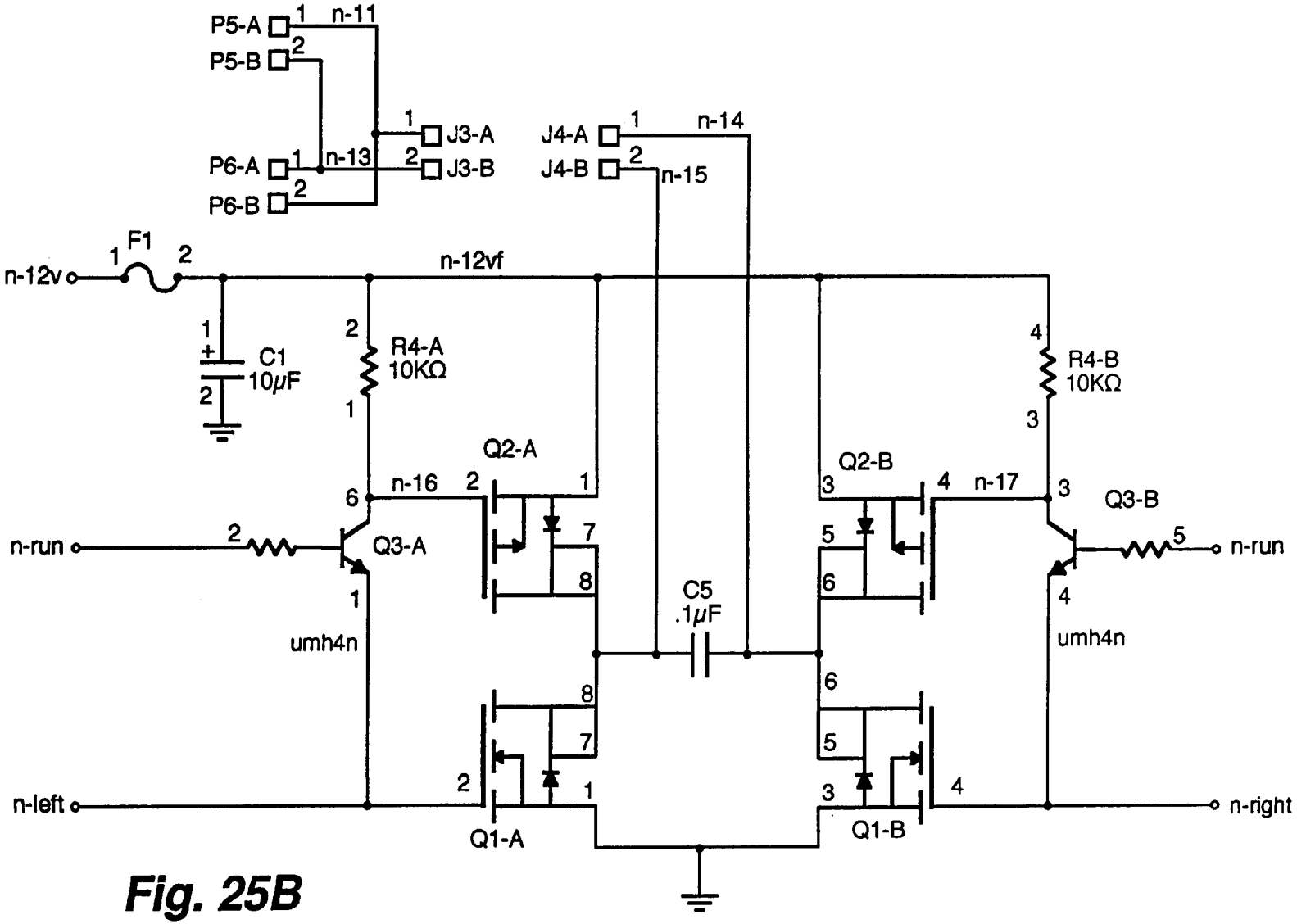
FIGS. 25B and 25C are circuit diagrams of the electronics that control operation of the control system.
Figure 25C:
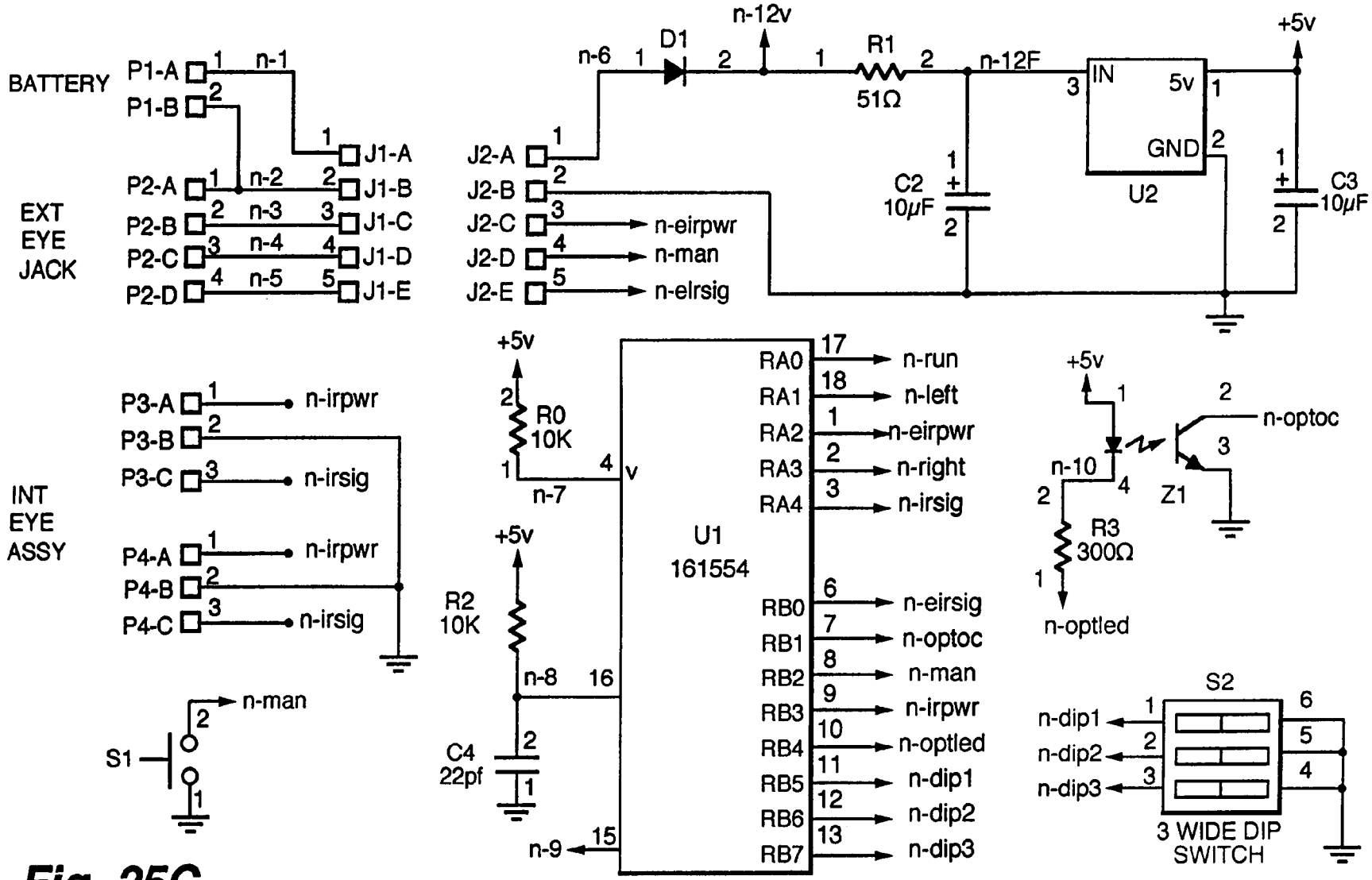

FIG. 25A is a block diagram of the control system electronics. FIGS. 25B and 25C are schematic diagrams of the control system electronics. The electronics are described next using FIGS. 25A, 25B, and 25C. Input power for the electronics is supplied by one or more batteries 208 connected in series. Connected between the battery 208 and the microprocessor 328 is circuitry 330 that provides battery reversal protection, a voltage regulator, noise filters, and a fuse to an H bridge. The voltage regulator is always on, and the quiescent current for the regulator is about one micro amp. A resistor R1 and two capacitors C2 and C5 together filter motor noise and prevent it from affecting the voltage regulator. A third capacitor C3 provides additional power filtering. Finally, the fuse F1 provides fault protection to the H bridge circuit. The microprocessor 328 has a built in "watch dog" timer that is used to wake up the microprocessor from sleep mode. Resistor R2 and capacitor C4 form an oscillator at nominally 2.05 MH (.+–0.25%). Resistor R0 allows for in-circuit programming.

The receiver 278 in the preferred embodiment is a 40 KHz infrared receiver connected to terminals P3 and P4. Power is supplied to the receiver directly from the microprocessor 328. The output from the receiver 278 (high when idle, low when a valid signal is being received) is connected to the microprocessor 328. An external photo-eye may be connected to terminal P2 (to board via jumper J1-2). It is automatically used as soon as it is connected (and the internal photo-eye is then ignored). Switch S1 is the manual operation switch 280, which is shown, for example, in FIG. 13. A slotted optical sensor 306 is mounted for rotation with the roll bar 138. A light emitter used in conjunction with the slotted optical sensor 306 is on only when the microprocessor 328 needs to check the sensor 306, and is driven by the microprocessor 328 with current limiting resistor R3. The output of the sensor (an open collector transistor) is connected to a microprocessor pin with an internal pull-up resistor.

Three leads from the microprocessor 328 control the H bridge: LEFT (left N MOSFET), RIGHT (right N MOSFET), and RUN (which turns on the appropriate P MOSFET). The N MOSFETs (Q1A and B) are turned on by placing five volts on the gate. A P MOSFET (Q2A or B) will be turned on when the RUN signal is high and either LEFT or RIGHT is low. When this happens, Q3A or B will turn on and pull the gate of Q2A or B to ground, which turns it on (R4A or B pulls the gate to the same level as the source, and keeps the P MOSFET off). This setup only allows a P MOSFET to be on if the N MOSFET on the same side is off. If both LEFT and RIGHT are low when RUN is active, then both P MOSFETs will turn on and act as a brake.

Diodes internal to the P MOSFETs provide protection from back EMF from the motor. The output of the H bridge connects to the motor via jumper J3-4 , then via connector P5 or P6 depending on left versus right-hand operation. Capacitor C5 filters some of the high frequency noise from the motor.

All times discussed in the present specification are nominal; actual times vary by .+–0.25%. Also when the IR receiver is turned on, during the first millisecond (msec) of the interval the output is ignored to allow the unit to settle.

The following discusses the modes of operation of the microprocessor 328.

Normal sleep/wake operation: Microprocessor 328 wakes up and checks the override button. If it is not pushed, the IR receiver 278 is turned on for 5.5 msec. Any active IR signal will cause the receiver 278 to be turned on again for 55 msec looking for a valid signal.

In sleep, the N MOSFETs are both on (brake), the P MOSFETs are off, the opto-sensor LED is off, the IR receiver 278 power and signal leads are driven low, and the option and manual switches are driven low. This is the minimal power state. Sleep lasts nominally 300 msec (210 minimum–480 maximum). This time is set by an RC timer inside the microprocessor 328 and is independent of the clock.

If the override button was pushed, then the IR receiver 278 is not turned on yet. The motor will be activated in the opposite direction from the last movement, and then the IR receiver 278 will start cycling (see below).

If any signals are present during the 5.5 msec test interval, then the receiver 278 stays off for 9.5 msec (during this time no other components are on besides the microprocessor 328). Then the receiver 278 is turned on for 55 msec. During this time, the receiver 278 is checked every 160 .mu.sec. This data is checked by a state machine. At the end of the interval, the receiver 278 is shut off. If a valid sequence (our channel either up or down) was not received, then the microprocessor 328 goes back to a sleep mode.

If a valid up (down) command was received, and the upper (lower) limit has not been reached, then the motor 144 is turned on going up (down). If the command was up (down), and the upper (lower) limit has been reached, then the remote button is checked to determine if it is held for more than 1.7 seconds. If so, then the limit is over-ridden and the motor 144 starts in the appropriate direction. If it later stalls, a new limit will be set. During this check, the microprocessor 328 stays on the entire time, and the receiver 278 is cycled 9.5 msec off, 55 msec on.

Motor running: The receiver 278 is cycled 9.5 msec off, 55 msec on. After the on time, the status is checked: (1) the button is still held from when the motor 144 started (leave motor running); (2) the button has been released (leave motor running); or (3) the button has been re-pushed which means stop (see below). In a similar fashion the manual override button is checked every cycle. If the opto-sensor 306 changes state, then the stall timer is reset and the revolution counter is updated depending on the direction the motor 144 and hence the covering are moving. If the covering is moving up, then it is checked to determine if it reached the upper limit, and if so, then the motor 144 is stopped. If the lower limit is reached and the covering is moving down, then the motor 144 is stopped. Finally, the stall timer is checked. If it expires, then the motor is stopped and a new limit is set.

Stop: The P MOSFETs are turned off, and after 1 msec, the N MOSFETs are both turned on (brake), then the manual pushbutton and the IR remote are checked to determine that they are no longer pushed, then the microprocessor 328 reverts to a sleep mode.

FIGS. 26, 27, 28, 29, 30, 31, and 32 together comprise a flow chart representation of the logic used by the control system of the present invention. The logic may be implemented in software or firmware for execution by the microprocessor 328. All times shown in the flow chart are nominal. Actual times may vary in the preferred embodiment by .+–0.25%. Items in a box are actions that are performed. Items in a diamond are tests that are made and the possible outcomes are written next to the arrows leaving the diamond. An arrow to a number goes to that number on another figure.

The following ten scenarios provide insight into how the control system electronics follow the logic depicted in FIGS. 26, 27, 28, 29, 30, 31, and 32.

Scenario 1: Batteries 208 first inserted, no buttons pushed. Execution starts with item 400 in FIG. 26, then 402 to initialize the system. The system then stays in the idle loop with items 404, 410, 416, and 420.

Figure 26:
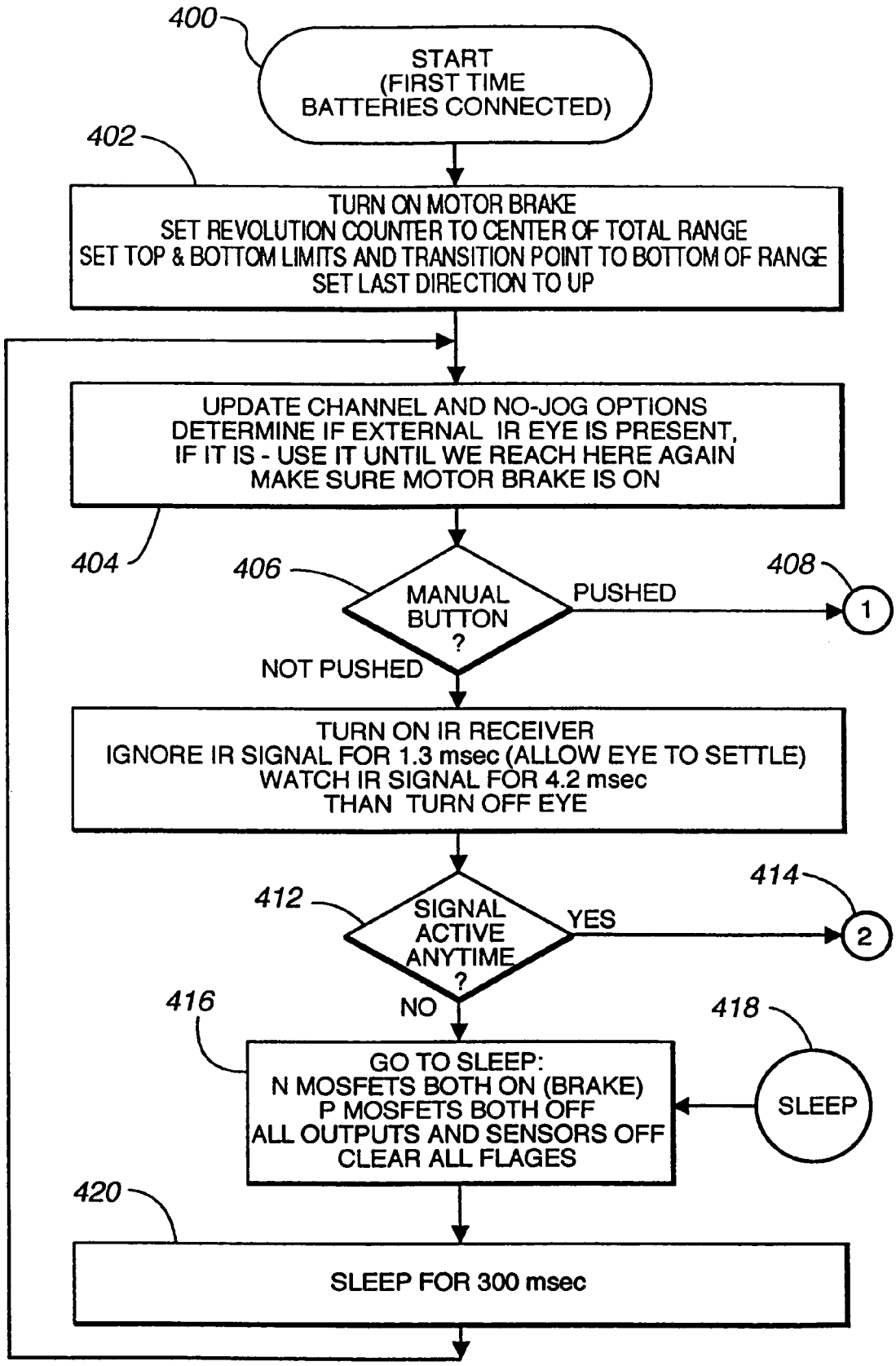
FIGS. 26, 27, 28, 29, 30, 31, and 32 together comprise a flow chart of the logic used by the control system of the present invention.
Figure 27:
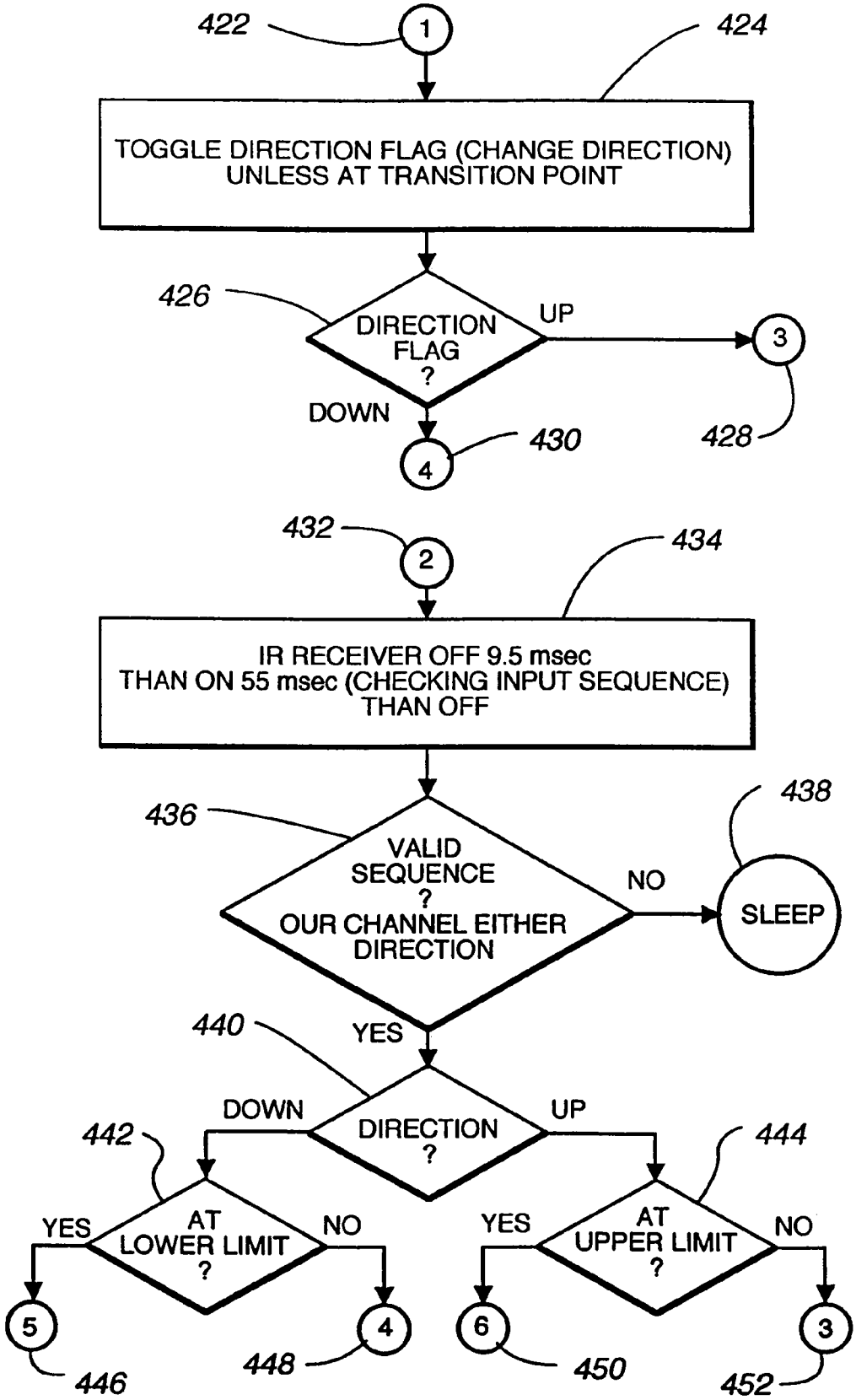
Figure 28:
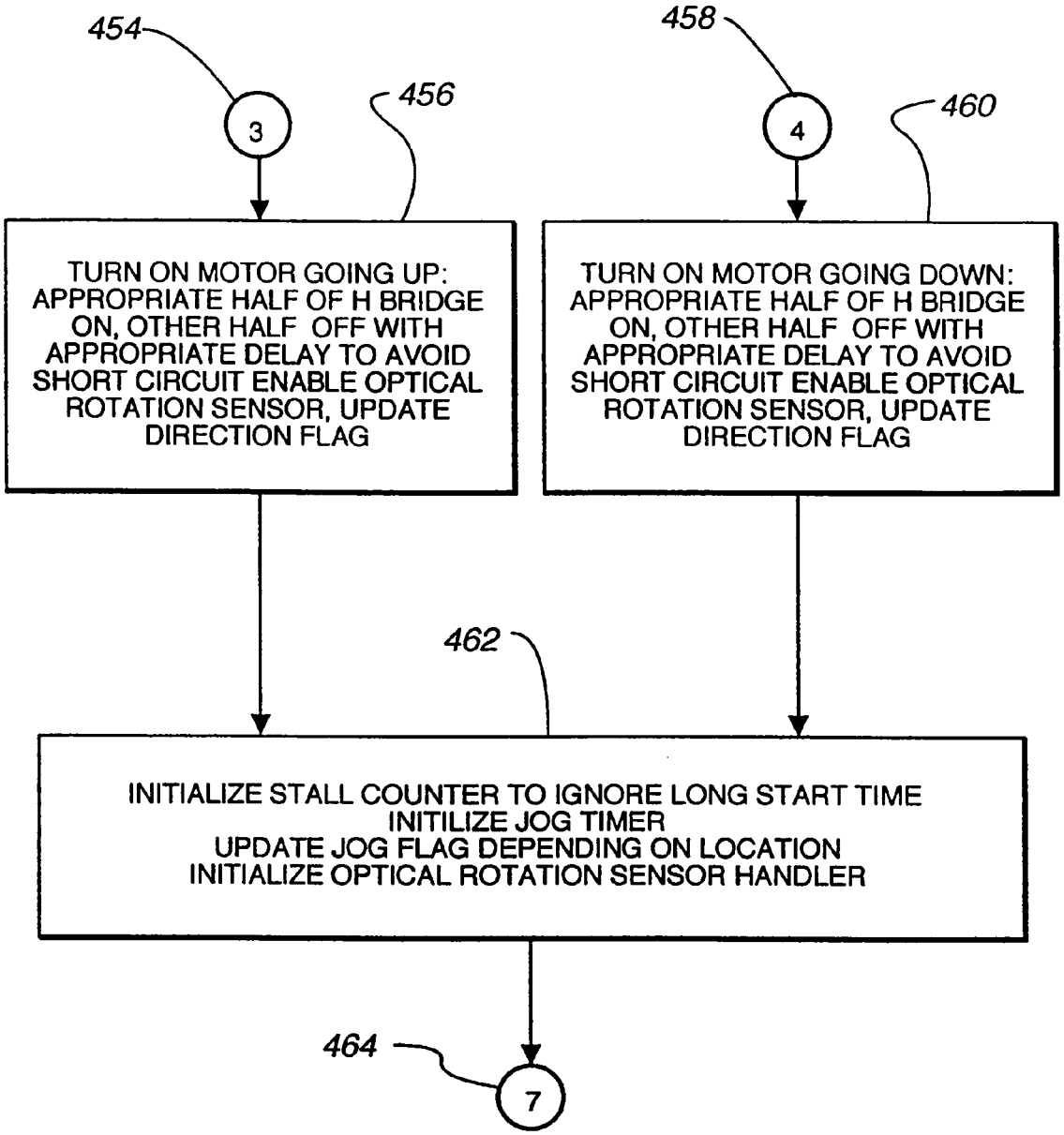
Figure 29:
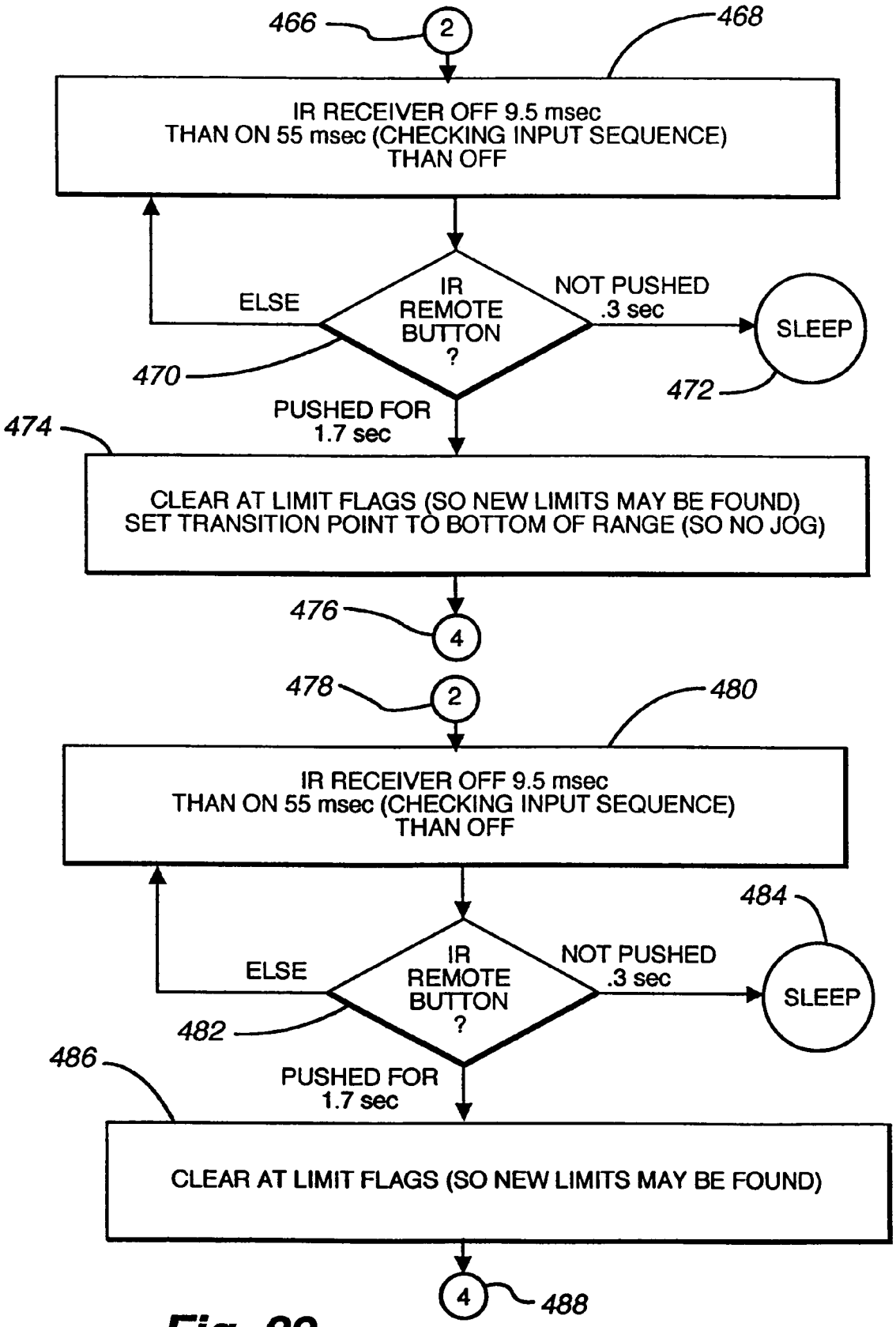

Scenario 2: Covering 14 not fully closed, motor 144 is stopped, the down button 322 on the transmitter 18 is pushed and released, and the user lets it go to the transition point. We are somewhere in the idle loop 404, 410, 426, 420 When item 412 completes, the result of the test will be yes, moving to condition 2 (i.e., from element 414 on FIG. 26 to element 432 on FIG. 27. Item 434 (FIG. 27) will cycle the IR sensor 278, which will decode the button, and we move to condition 4 (i.e., from element 448 on FIG. 27 to element 458 on FIG. 28), which executes items 460 and 462, which starts the motor 144 going down, full speed, and we move to condition 7 (i.e., from element 464 on FIG. 28 to element 490 on FIG. 30). We are now in a loop doing item 492. As the motor 144 turns, the rotating sensor 306 will change, causing us to go to condition 8 (i.e., from element 496 on FIG. 30 to element 512 on FIG. 31), and item 520 where we decrement the rotation counter. Assuming we do not reach the transition point, we move back to condition 7 (i.e., from element 546 on FIG. 31 to element 490 on FIG. 30) and the loop doing item with the motor 144 running at full speed. Task number 11n item 492 will cause the system to check if the button 310 on the transmitter 18 is still pushed. When it is released, this is noted. The motor 144 continues, and we go back to the loop doing item 492. Finally, the covering 14 reaches the transition point. We go through items 514, 520, 524, 532, 536 (FIG. 31) and condition 10 (i.e., we move from element 542 of FIG. 31 to element 506 of FIG. 30), and item 508 which stops the motor 144 and puts us back in the idle loop 404, 410, 416, 420 (FIG. 26).

Scenario 3: Covering 14 not fully closed, motor 144 is stopped, the down button 322 on the transmitter 18 is pushed then released, and the user lets it go awhile, then pushes the button 322 again to stop the covering 14 partially closed. We got to the loop doing item 492 (FIG. 30) the same as scenario 2. Task number 1 in item 492 will cause the system to check if the button 322 on the transmitter 18 is still pushed. When it is released, this is noted. The motor 144 continues, and we go back to the loop doing item 492. When the button 322 is re-pushed, this same task takes us to condition 10 where we go to item 508, where we stop the motor 144. We stay in item 508 until the button is released. Then we go back to the idle loop 404, 410, 416, 420 (FIG. 26).

Scenario 4: Covering 14 not fully closed, motor 144 is stopped, the up button 320 on the transmitter 18 is pushed and released, and the user lets it go to the top limit. We are somewhere in the idle loop 404, 410, 416, 420 (FIG. 26). When item 410 completes, the result of the test in item 412 will be "yes," moving to condition 2 (i.e., we move from element 414 of FIG. 26 to element 432 of FIG. 27). Item 434 will cycle the IR sensor 278, which will decode the button 320, and we move to condition 3 (i.e., we move from element 452 in FIG. 27 to element 454 of FIG. 28), which executes items 456 and 462, which starts the motor 144 going up, full speed, and we now transfer from element 464 of FIG. 28 to element 490 of FIG. 30. We are now in a loop doing item 492. As the motor 144 turns, the rotation sensor will change, causing us to go to condition 8 (i.e., from element 496 of FIG. 30 to element 512 of FIG. 31) and item 518, where we increment the rotation counter 306. Assuming we do not reach the top, we go back to the loop doing item 492 (FIG. 30) with the motor 144 running at full speed. Task number 1 in item 492 will cause the system to check if the button 320 on the transmitter 18 is still pushed. When it is released, this is noted. The motor 144 continues and we go back to the loop doing item 492. Finally, the covering 14 reaches the upper limit. We go through items 514, 518, 526 (FIG. 31) and condition 10 (i.e., from element 530 of FIG. 31 to element 506 in FIG. 30), and item 508, which stops the motor 144 and puts us back in the idle loop 404, 410, 416, 420.

Scenario 5: Covering 14 not fully open, motor 144 is stopped, the up button 320 on the transmitter 18 is pushed then released, and the user lets it go awhile, then pushes the button 320 again to stop it partially open. We get to the loop doing item 492 (FIG. 30) the same as scenario 4. Task number 11n item 492 will cause the system to check if the button 320 on the transmitter 18 is still pushed. When it is released, this is noted. The motor 144 continues, and we go back to the loop doing item 492. When the button 320 is re-pushed, this same task takes us to condition 10 where we go to item 510, where we stop the motor 144. We stay in item 510 until the button 320 is released. Then we go back to the idle loop 404, 410, 416, 420 (FIG. 26).

Figure 30:
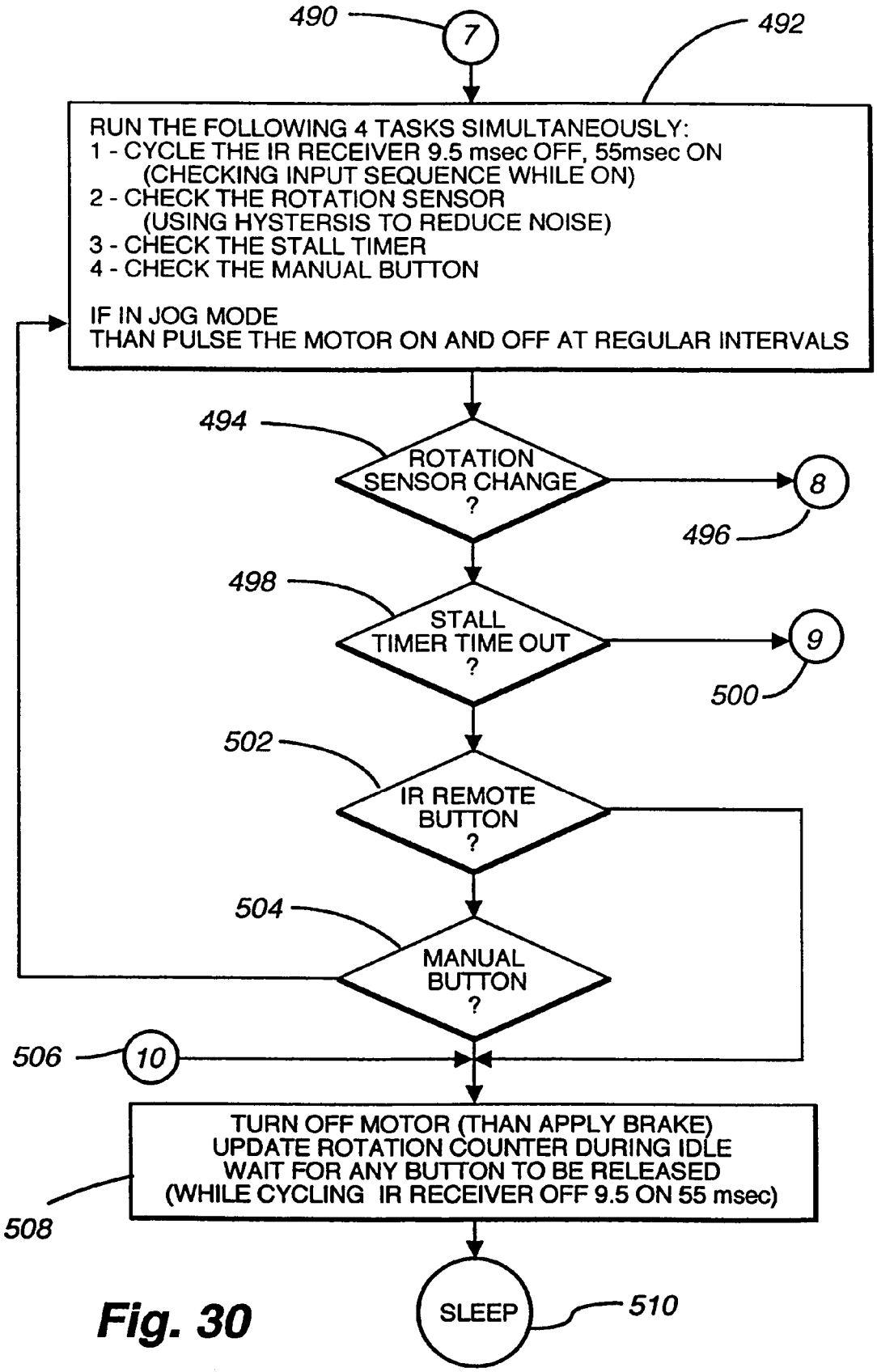
Figure 31:
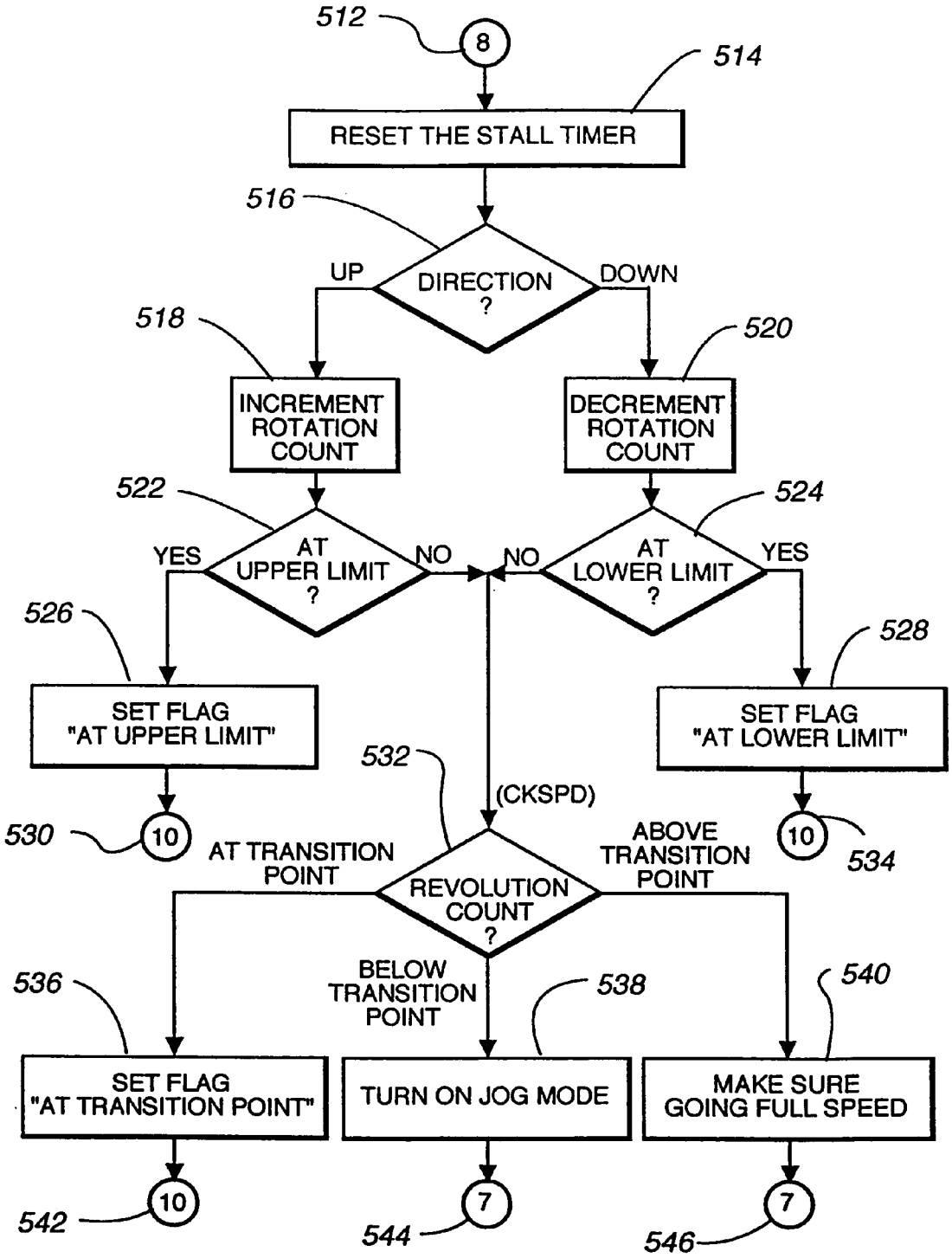
Figure 32:
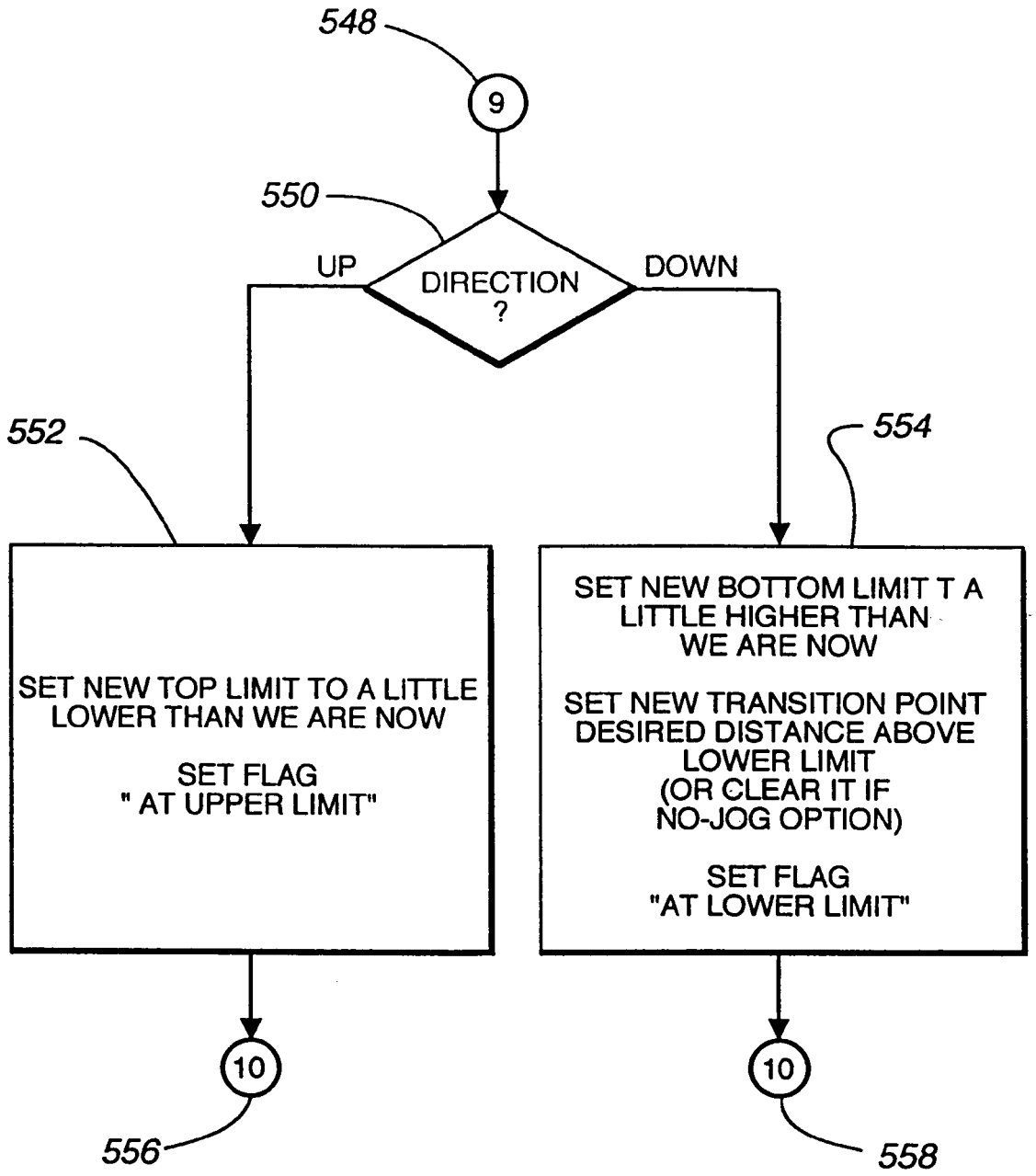

Scenario 6: Covering 14 at top limit, motor 144 is stopped, the up button 320 on the transmitter 18 is pushed and held until the limit is over-ridden, and the user lets it go to the top stall (or stalls it partially open to set a new upper limit). We are somewhere in the idle loop 404, 410, 416, 420 (FIG. 26). When item 410 completes, the result of the test in item 412 will be "yes," moving to condition 2 (i.e., from element 414 in FIG. 26 to element 432 in FIG. 27). Item 434 will cycle the IR sensor 278, which will decode the button 320, and we move to condition 4 (i.e., from element 448 in FIG. 27 to element 458 in FIG. 28), which executes item 460 and 462, which starts the motor 144 going down, full speed. We are now in a loop doing item 492 (FIG. 30). As the motor 144 turns, the rotation sensor will change, causing us to go to condition 8 (i.e., from element 496 on FIG. 30 to element 512 on FIG. 31) and item 520, where we decrement the rotation counter 306. Assuming we do not reach the bottom, we go back to the loop doing item 492 with the motor 144 running at full speed. When the motor 144 reaches the top, or for any other reason stops rotating (stalls), the stall timer will time-out, and we go to condition 9 (i.e., from element 500 in FIG. 30 to element 548 in FIG. 32). We execute item 552 to set the new upper limit, then go to item 508 (FIG. 30), where we stop the motor 144. Then we go back to the idle loop 404, 410, 416, 420 (FIG. 26). Task number 11n item 492 (FIG. 30) will cause the system to check if the button on the transmitter 18 is still pushed. When it is released, this is noted. The motor 144 continues and we go back to the loop doing item 492.

Scenario 7: Brand new covering 14 not at bottom, motor 144 is stopped, the down button 322 on the transmitter 18 is pushed and released, and the user lets it go to the bottom stall. We are somewhere in the idle loop 404, 410, 416, 420 (FIG. 26). When item 410 completes, the result of the test in item 412 will be "yes," moving to condition 2 (i.e., from element 414 in FIG. 26 to element 432 of FIG. 27). Item 434 will cycle the IR sensor 278, which will decode the button 322, and we move to condition 4 (i.e., from element 448 of FIG. 27 to element 458 of FIG. 28) which executes item 460 and 462, which starts the motor 144 going down, full speed. We are now in a loop doing item 492 (FIG. 30). As the motor 144 turns, the rotation sensor will change, causing us to go to condition 8 (i.e., from element 496 of FIG. 30 to element 512 of FIG. 31) and item 520, where we decrement the rotation counter 306. Assuming we do not reach the bottom, we go back to the loop doing item 492 (FIG. 30) with the motor 144 running at full speed. When the motor 144 reaches the bottom, or for any other reason stops rotating (stalls), the stall timer will time-out, and we go to condition 9 (i.e., from element 500 of FIG. 30 to element 548 of FIG. 32). We execute item 554 (FIG. 32) to set the new lower limit and transition point, then go to item 508 (FIG. 30) where we stop the motor 144. Then we go back to the idle loop 404, 410, 416, 420 (FIG. 26). Task number 11n item 492 (FIG. 30) will cause the system to check if the button 322 on the transmitter 18 is still pushed. When it is released, this is noted. The motor 144 continues and we go back to the loop doing item 492.

Scenario 8: Covering 14 fully closed, motor 144 is stopped, the down button 322 on the transmitter 18 is pushed unintentionally and released quickly. We are somewhere in the idle loop 404, 410, 416, 420 (FIG. 26). When item 410 completes, the result of the test in item 412 will be "yes," moving to condition 2 (i.e., from element 414 of FIG. 26 to element 432 of FIG. 27). Item 434 will cycle the IR sensor 278, which will decode the button 322, and we move to condition 5 (i.e., from element 446 of FIG. 27 to element 466 of FIG. 29), which starts the loop running item 468. When the user realizes the covering 14 is already down and releases the button 322, we go to the idle loop 404, 410, 426, 20 (FIG. 26).

Scenario 9: Covering 14 fully open, motor 144 is stopped, the up button 320 on the transmitter 18 is pushed unintentionally and released. We are somewhere in the idle loop 404, 410, 416, 420 (FIG. 26). When item 410 completes, the result of the test in item 412 will be "yes," moving to condition 2 (i.e., from element 414 of FIG. 26 to element 432 of FIG. 27). Item 434 will cycle the IR sensor 278, which will decode the button 320, and we move to condition 6 (i.e., from element 450 in FIG. 27 to element 478 in FIG. 29), which starts the loop running item 480. When the user realizes the covering 14 is already down and releases the button 320, we go to the idle loop 404, 410, 416, 420 (FIG. 26).

Scenario 10: Same as scenarios 2–6 but the manual button 280 is pushed instead of the IR button 310. Instead of moving to condition 2 we go to condition 1 (i.e., from element 408 in FIG. 26 to element 422 in FIG. 27). We then go the opposite way that we moved last time. We then go to condition 3 (i.e., from element 428 in FIG. 27 to element 454 in FIG. 28) or 4 (i.e., from element 430 in FIG. 27 to element 458 in FIG. 28) just like we pushed the appropriate button on the remote 18. We get to loop doing item 492 (FIG. 30), and the scenarios are the same except we note the manual button 280 is released instead of the remote button 310. If the manual button 280 is re-pushed (as in scenario 3 or 5), then we execute item 508, which stops the motor 144, and then we go to the idle loop 404, 410, 416, 420 (FIG. 26).

Although preferred embodiments of this invention have been described above, those skilled in the art could make numerous alterations to the disclosed embodiments without departing from the spirit or scope of this invention. Further, all directional references (e.g., up, down, leftward, rightward, bottom, top, inner, outer, above, below, clockwise, and counterclockwise) used above are to aid the reader's understanding of the present invention, but should not create limitations, particularly as to the orientation of the apparatus. It is intended that all matter contained in the above description or shown in the accompanying drawings shall be interpreted as illustrative only and not limiting.

We claim:

1. A method of using a control system adapted to receive at least one signal to activate a motor to adjust a configuration of an adjustable covering, wherein the configuration is variably adjustable between a fully extended configuration and a fully retracted configuration, and, when the adjustable covering is in the fully extended configuration, the configuration is variably adjustable between a maximum transmissivity configuration and a minimum transmissivity configuration, wherein each press of a manual operating switch is alternatingly treated as an up request followed by a down request, comprising:

detecting an extension of the adjustable covering;

wherein the adjustable covering is mounted to a roll bar comprising a forward extending rib; whereby the adjustable covering is fully extended upon the forward extending rib coming into contact with a working half pivotally attached to a mounting half of a limit stop;

detecting an amount of transmissivity of the adjustable covering;

detecting a speed of the adjustable covering;

monitoring a signal for an indication of one of an up request and a down request; and instructing the motor to make an adjustment to the adjustable covering upon recognizing the signal, wherein the adjustment is based upon the detected depth, the monitored amount of transmissivity, the monitored speed, and the monitored signal.

2. A method of using a control system to receive signals from a wireless remote control having an up button and a down button and remotely activate a motor to adjust a configuration of an adjustable covering for an architectural opening, wherein the configuration is variably adjustable between a fully extended configuration and a fully retracted configuration, and, when the adjustable covering is in the fully extended configuration, the configuration is variably adjustable between a maximum transmissivity configuration and a minimum transmissivity configuration, comprising:

monitoring an amount of extension of the adjustable covering;

the monitoring further comprising detecting full extension when contact occurs between an extending rib and a member of a limit stop;

monitoring an amount of transmissivity of the adjustable covering;

monitoring a speed of the adjustable covering;

detecting a signal from the remote control for an indication of a pressing of one of the up button and the down button; and commanding the motor to make a determined adjustment to the adjustable covering upon detecting the signal from the remote control, wherein the determined adjustment is based upon at least one of the monitored amount of extension, the monitored amount of transmissivity, the monitored speed, and the detected signal;

wherein when the adjustable covering is fully extended and the adjustment consists of adjusting the amount of transmissivity of the covering, the motor operates in a second speed that is slower than a first speed.

3. The method of claim 2, wherein when the monitored amount of extension is fully extended, the monitored amount of transmissivity is between minimum transmissivity and maximum transmissivity, the monitored speed of the adjustable covering is zero, the monitored signal from the remote control is recognized as pressing of the down button, and the commanding step comprises commanding the motor to increase the amount of transmissivity of the covering.

4. The method of claim 2, wherein when the monitored amount of extension is fully retracted, the monitored amount of transmissivity is minimum transmissivity, the monitored speed of the adjustable covering is zero, the monitored signal from the remote control is recognized as a single pressing and release of the down button, and the commanding step comprises commanding the motor to increase the amount of extension of the covering.

5. The method of claim 2, wherein when the monitored amount of extension is between fully retracted and fully extended, the monitored amount of transmissivity is minimum transmissivity, the monitored speed of the adjustable covering is nonzero, the monitored signal from the remote control is recognized as a pressing of one of the up button and the down button, and the commanding step comprises commanding the motor to stop.

6. A method of using a control system adapted to receive at least one signal to activate a motor to adjust a configuration of an adjustable covering, wherein the configuration is variably adjustable between a fully extended configuration and a fully retracted configuration, and, when the adjustable covering is in the fully extended configuration, the configuration is variably adjustable between a maximum transmissivity configuration and a minimum transmissivity configuration, wherein each press of a manual operating switch is alternatingly treated as an up request followed by a down request, comprising:

detecting an extension of the adjustable covering;

wherein the adjustable covering is mounted to a roll bar comprising a forward extending rib; whereby the adjustable covering is fully extended upon the forward extending rib coming into contact with a working half pivotally attached to a mounting half of a limit stop;

detecting an amount of transmissivity of the adjustable covering;

detecting a speed of the adjustable covering;

monitoring a signal for an indication of one of an up request and a down request; and instructing the motor to make an adjustment to the adjustable covering upon recognizing the signal, wherein the adjustment is based upon the detected depth, the monitored amount of transmissivity, the monitored speed, and the monitored signal; and instructing the motor to operate at a first speed when adjusting the amount of extension of the covering.

7. The method of claim 6, wherein when the monitored amount of extension is fully extended, the monitored amount of transmissivity is maximum transmissivity, the monitored speed of the adjustable covering is zero, and the monitored signal from the remote control is recognized as pressing of the up button, the commanding step comprises commanding the motor to reduce the amount of transmissivity of the covering.

8. The method of claim 6, wherein when the monitored amount of extension is fully extended, the monitored amount of transmissivity is minimum transmissivity, the monitored speed of the adjustable covering is zero, and the monitored signal from the remote control is recognized as pressing of the up button, the commanding step comprises commanding the motor to reduce the amount of extension of the covering.

9. The method of claim 6, wherein when the monitored amount of extension is fully extended, the monitored amount of transmissivity is minimum transmissivity, the monitored speed of the adjustable covering is zero, and the monitored signal from the remote control is recognized as pressing of the down button, the commanding step comprises commanding the motor to increase the amount of transmissivity of the covering.

10. The method of claim 6, wherein when the monitored amount of extension is fully extended, the monitored amount of transmissivity is between minimum transmissivity and maximum transmissivity, the monitored speed of the adjustable covering is nonzero, the monitored signal from the remote control is recognized as pressing of one of the up button and the down button, and the commanding step comprises commanding the motor to stop.

11. The method of claim 6, wherein when the monitored amount of extension is fully extended, the monitored amount of transmissivity is between minimum transmissivity and maximum transmissivity, the monitored speed of the adjustable covering is zero, the monitored signal from the remote control is recognized as pressing of the up button, and the commanding step comprises commanding the motor to reduce the amount of transmissivity of the covering.

12. A method of using a control system adapted to receive at least one signal to activate a motor to adjust a configuration of an adjustable covering, wherein the configuration is variably adjustable between a fully extended configuration and a fully retracted configuration, and, when the adjustable covering is in the fully extended configuration, the configuration is variably adjustable between a maximum transmissivity configuration and a minimum transmissivity configuration, wherein each press of a manual operating switch is alternatingly treated as an up request followed by a down request, comprising:

detecting a depth of the adjustable covering;

wherein the adjustable covering is mounted to a roll bar comprising a forward extending rib; whereby the adjustable covering is fully extended upon the forward extending rib coming into contact with a working half, pivotally attached to a mounting half of a limit stop;

detecting an amount of transmissivity of the adjustable covering;

detecting a speed of the adjustable covering;

monitoring a signal for an indication of one of an up request and a down request; and instructing the motor to make an adjustment to the adjustable covering upon recognizing the signal, wherein the adjustment is based upon the detected depth, the monitored amount of transmissivity, the monitored speed, and the monitored signal;

wherein when the adjustable covering is fully extended and the adjustment consists of adjusting the amount of transmissivity of the covering, the motor operates in a second speed that is slower than a first speed.

13. A method of using a control system adapted to receive at least one signal to activate a motor to adjust a configuration of an adjustable covering, wherein the configuration is variably adjustable between a fully extended configuration and a fully retracted configuration, and, when the adjustable covering is in the fully extended configuration, the configuration is variably adjustable between a maximum transmissivity configuration and a minimum transmissivity configuration, wherein each press of a manual operating switch is alternatingly treated as an up request followed by a down request, comprising:

detecting an extension of the adjustable covering;

wherein the adjustable covering is mounted to a roll bar comprising a forward extending rib; whereby the adjustable covering is fully extended upon the forward extending rib coming into contact with a working half, pivotally attached to a mounting half of a limit stop;

detecting an amount of transmissivity of the adjustable covering;

detecting a speed of the adjustable covering;

monitoring a signal for an indication of one of an up request and a down request; and instructing the motor to make an adjustment to the adjustable covering upon recognizing the signal, wherein the adjustment is based upon the detected depth, the monitored amount of transmissivity, the monitored speed, and the monitored signal;

monitoring the motor for a stalled condition, and when a stalled condition occurs, commanding the motor to stop; and determining a configuration of the adjustable covering based upon the monitored amount of extension of the adjustable covering.

14. The method of claim 13, wherein when the monitored amount of extension is between fully retracted and fully extended, the monitored amount of transmissivity is minimum transmissivity, the monitored speed of the adjustable covering is zero, the monitored signal from the remote control is recognized as a selection of the up button, and the commanding step comprises commanding the motor to reduce the amount of extension of the covering.

15. The method of claim 13, wherein when the monitored amount of extension is between fully retracted and fully extended, the monitored amount of transmissivity is minimum transmissivity, the monitored speed of the adjustable covering is zero, the monitored signal from the remote control is recognized as a selection of the down button, and the commanding step comprises commanding the motor to increase the amount of extension of the covering.

16. The method of claim 13, wherein the control system simultaneously monitors the transmissivity of the adjustable covering and the speed of the adjustable covering.

17. The method of claim 13, wherein the control system further determines the speed of the adjustable covering and the transmissivity of the adjustable covering.

18. The method of claim 17, wherein the speed determination occurs prior to the transmissivity determination.

19. The method of claim 13, wherein the determined adjustment is predetermined.

* * * * *